US008001745B2

(12) United States Patent
Carter et al.

(10) Patent No.: US 8,001,745 B2
(45) Date of Patent: Aug. 23, 2011

(54) SYSTEMS FOR MONITORING AND CONTROLLING USAGE OF MATERIALS

(75) Inventors: Russell M. Carter, Wilmington, NC (US); Bruce E. Laughter, Monroe, NC (US); Robert J. Walker, Leland, NC (US)

(73) Assignee: Atlantic Corporation, Wilmington, NC (US)

( * ) Notice: Subject to any disclaimer, the term of this patent is extended or adjusted under 35 U.S.C. 154(b) by 259 days.

(21) Appl. No.: 12/475,147

(22) Filed: May 29, 2009

(65) Prior Publication Data

US 2009/0293425 A1 Dec. 3, 2009

Related U.S. Application Data

(60) Provisional application No. 61/057,059, filed on May 29, 2008.

(51) Int. Cl.
*B65B 57/02* (2006.01)
*B65B 11/04* (2006.01)

(52) U.S. Cl. ..... 53/64; 53/508; 53/556; 53/587; 53/588; 53/389.4

(58) Field of Classification Search ..... 53/52, 64, 53/507, 508, 556, 168, 587, 588, 389.1, 389.2, 53/389.4
See application file for complete search history.

(56) References Cited

U.S. PATENT DOCUMENTS 3,867,806 A 2/1975 Lancaster, III et al.
4,050,221 A 9/1977 Lancaster, III et al.
4,077,179 A 3/1978 Lancaster et al.
4,232,501 A 11/1980 Stackhouse
4,248,031 A 2/1981 Del Pozo, Jr.
4,283,903 A * 8/1981 Mayhall et al. ..... 53/587
4,302,920 A 12/1981 Lancaster et al.
4,317,322 A 3/1982 Lancaster et al.
4,387,548 A 6/1983 Lancaster et al.
4,387,552 A 6/1983 Lancaster et al.
4,501,105 A 2/1985 Rogers et al.
(Continued)

FOREIGN PATENT DOCUMENTS

EP 0569 615 11/1993
(Continued)

OTHER PUBLICATIONS

International Search Report and Written Opinion for PCT/US2009/045691 dated Nov. 19, 2009, 9 pages.

*Primary Examiner* — Stephen F Gerrity
(74) *Attorney, Agent, or Firm* — Jenkins, Wilson, Taylor & Hunt P.A.

(57) ABSTRACT

Material usage tracking systems for monitoring and optimizing usage of stretch film on a stretch wrapping machine is provided. A system includes a rotary encoder collar securable to a pre-stretch roller of a stretch wrapping machine and a proximity sensor securable proximate to the rotary encoder collar. Upon installation, the proximity sensor measures the revolutions of the pre-stretch roller when the stretch wrapping machine is wrapping a product or pallet. The system also includes a controller in communication with the proximity sensor. The controller converts the revolutions of the pre-stretch roller to measurements of the amount of stretch film pulled off a film roll in the stretch wrapping machine based on data received from the proximity sensor. Different uses for the data collected by the material usage tracking system and different ways of presentation of the data are also provided.

73 Claims, 24 Drawing Sheets

U.S. PATENT DOCUMENTS

| | | | | |
|---|---|---|---|---|
| 4,502,264 | A | 3/1985 | Flaherty | |
| 4,514,955 | A * | 5/1985 | Mouser et al. | 53/64 |
| 4,565,045 | A * | 1/1986 | Ikemoto | 53/64 |
| 4,979,358 | A | 12/1990 | Keip | |
| 5,027,579 | A | 7/1991 | Keip | |
| 5,163,264 | A | 11/1992 | Hannen | |
| 5,203,139 | A * | 4/1993 | Salsburg et al. | 53/556 |
| 5,524,413 | A * | 6/1996 | Fukuda | 53/64 |
| 5,570,564 | A | 11/1996 | Moore et al. | |
| 6,093,480 | A | 7/2000 | Eichbauer | |
| 6,185,914 | B1 | 2/2001 | Mackie | |
| 6,370,839 | B1 | 4/2002 | Nakagawa et al. | |
| RE38,429 | E | 2/2004 | Eichbauer | |
| 6,918,229 | B2 | 7/2005 | Lancaster, III et al. | |
| 6,966,162 | B2 | 11/2005 | Viaud et al. | |
| 7,114,308 | B2 | 10/2006 | Cox | |
| 7,243,476 | B2 | 7/2007 | Schneider | |
| 7,368,160 | B2 | 5/2008 | Inglis | |
| 2005/0010323 | A1 * | 1/2005 | Cocciadiferro et al. | 700/174 |
| 2005/0029391 | A1 * | 2/2005 | Cocciadiferro et al. | 242/559.1 |
| 2005/0072802 | A1 * | 4/2005 | Hanna et al. | 222/145.5 |
| 2007/0204565 | A1 | 9/2007 | Lancaster, III et al. | |

FOREIGN PATENT DOCUMENTS

| | | |
|---|---|---|
| EP | 1327583 | 7/2003 |
| FR | 2631922 A1 * | 12/1989 |
| WO | WO 2007/100596 | 9/2007 |

* cited by examiner

Presentation Layouts

Here are representative layouts for each of the five (5) Presentation Layers. Accompanying each layout is one or more representative example(s) of the layout:

Authentication Layer

HEADER INFORMATION

AUTHENTICATION AREA

Login

Password

Cancel OK

ATLANTIC CORPORATION

Authorization Required

For the protection of our customers, access to this website is restricted with an email address and password.

Email Address Password robbiew@atlanticpkg.com ••••••••••••••

Login

Fill in Email Address And Click "Send Password" if you have lost your password.

Send Password or

FIG. 10

M.U.S.T. Materials Usage Standard Tracking Only Available From ATLANTIC PACKAGING

*ANOTHER ATLANTIC ADVANTAGE FOR*

ACME Corporation

Acme Corporation

Business Units Reporting 7

Percent Within Benchmark 71%

Reporting Outside Benchmark

Canada

West

Source Reduction 1.67 Million Pounds per month.

Source reduction values are calculated from audited values prior to M.U.S.T. System installation.

| Business Unit | Status |
|---|---|
| Canada | Some lines reporting high... |
| Brampton | On Target |
| Calgary | On Target |
| Lachine | Some lines reporting high... |
| Trois Rivieres | On Target |
| Vancouver | On Target |
| Weston | On Target |
| Winnipeg | On Target |

*Click Facility Name to open location...*

| | |
|---|---|
| Great Lakes | Unable to connect to all lines... |
| Midwest | All lines reporting normal... |
| Northeast | All lines reporting normal... |
| Southeast | All lines reporting normal... |
| Southwest | All lines reporting normal... |
| West | All lines reporting normal... |

*Click Business Unit Name to drilldown to Locations...*

FIG. 11B

M.U.S.T.
Materials Usage Standard Tracking

Data Paths
Web Interface
Dashboard

M.U.S.T. Materials Usage Standard Tracking
Only Available From ATLANTIC PACKAGING

ANOTHER ATLANTIC ADVANTAGE FOR

ACME Corporation

Southeast

College Park, GA

Source Reduction 7,175 Pounds/month

Source reduction is relative to audited film usage rates prior to M.U.S.T. System Installation.

Reporting Dates:

04/26/08 12:00:00 AM

Set Start Date

05/23/08 11:59:59 PM

Set End Date

Acme Fiscal Date Entry Shortcuts:

| Year | Quarter | Month | | |
|---|---|---|---|---|
| 2007 | 3rd Quarter | | Aug | Sep |
| | 4th Quarter | Oct | Nov | Dec |
| 2008 | 1st Quarter | Jan | Feb | Mar |
| | 2nd Quarter | Apr | May | Jun |
| | 3rd Quarter | Jul | Aug | Sep |
| | 4th Quarter | Oct | Nov | Dec |

| Line | Status |
|---|---|
| Line 1A Wulftec Wrapper # 3128 | High Film/Pallet |
| Line 1B Wulftec Wrapper # 3127 | Low Film/Pallet |
| Line 3A Lantech Wrapper # S-0046 | On Target |
| Line 3B Lantech Wrapper # S-0047 | On Target |
| Line 4A Wulftec Wrapper # 3130 | Low Film/Pallet |
| Line 4B Wulftec Wrapper # 3129 | On Target |
| Warehouse Lantech Wrapper # S-0154 | No Good Values In 5 days |

*Click "Status" buttons for details...*

FIG. 12B

M.U.S.T.
Materials Usage Standard Tracking

Data Paths Web Interface Locations

M.U.S.T. Materials Usage Standard Tracking Only Available From ATLANTIC PACKAGING

*ANOTHER ATLANTIC ADVANTAGE FOR*

ACME Corporation

College Park, GA

Line 1A Wulftec Wrapper # 3128

Report Between
04/26/2008 12:00:00 AM
and
05/23/2008 11:59:59 PM

| | |
|---|---|
| Avg. Oz./Pallet | 2.76 |
| Total Pallets | 3897 |
| Target Rev/Pallet | 7 |
| Avg. Rev/Pallet | 7.001 |

At current usage rate, stretch film consumption is being reduced by 998.76 pounds per month on this wrapper.

Source reduction is compared to usage from audits before M.U.S.T. System Installation

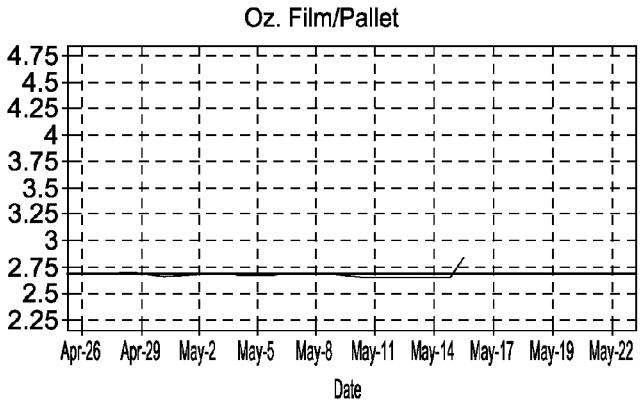

FIG. 13B

M.U.S.T.
Materials Usage Standard Tracking

Data Paths Web Interface Lines

Atlantic Packaging M.U.S.T. System http:// must.atlanticpkg.com/MUST/WebApp/NodeStatus.jsp Google M.U.S.T. Materials Usage Standard Tracking

ATLANTIC PACKAGING

Logout > Dashboard > Select Node > Lines

Start Date:
04/11/2009
mm/dd/yyy
End Date:
05/11/2009
mm/dd/yyy

Packaging Lines

| | Line | Status |
|---|---|---|
| ☑ | Line 1A | OK |
| ☐ | Line 1B | OK |
| ☐ | Line 4B | OK |
| ☐ | Line 4A | OK |
| ☐ | Line 2 | Excessive Film |
| ☐ | Line 3B | OK |
| ☐ | Line 3A | OK |

Report Chart

Stretch Film Us

Click here to view a chart for this line...

| Line | Pallets | Wrap | Lbs. Film | S/Pallet | Total $ |
|---|---|---|---|---|---|
| Line 1A | 2899 | Can Line | 423.51 | | |
| Line 1B | 2895 | Can Line | 432.54 | | |
| Line 2 | 4377 | Can Line | 874.33 | | |
| Line 3A | 6988 | PET | 1,674.34 | | |
| Line 3B | 6588 | PET | 1,485.54 | | |
| Line 4A | 7741 | Can Line | 1,246.15 | | |
| Line 4A | 2 | 18 Pack | 0.32 | | |
| Line 4B | 1 | 18 Pack | 0.69 | | |
| Line 4B | 5444 | Can Line | 963.79 | | |

Copyright©2007–2008: Atlantic Corp of Wilmington. All rights reserved. Patent Pending

ATLANTIC PACKAGING

Loading "http://must.atlanticpkg.com/MUST/WebApp/NodeStatus.js", completed 7 of 8 items

FIG. 13C

M.U.S.T. Materials Usage Standard Tracking Only Available From ATLANTIC PACKAGING ANOTHER ATLANTIC ADVANTAGE FOR ACME Corporation Report Period Start Date
01/01/2008

End Date
03/31/2008

○ All Locations

○ One Location
-- Select One --

Report Period

○ Film Use - All Locations - All Lines
○ Film Use - All Locations
○ Film Use - Trend
○ Film Use - Statistics
○ Source Reduction - All Locations - All Lines
○ Source Reduction - All Locations
○ Source Reduction - Statistic
○ Equipment Analysis Cancel Proceed

FIG. 14B

M.U.S.T.
Materials Usage Standard Tracking

Data Paths Web Interface Graph

M.U.S.T.
Materials Usage Standard Tracking

Data Paths Web Interface Report 1

Atlantic Packaging M.U.S.T. System http:// must.atlanticpkg.com/MUST/WebApp/ViewReports.jsp?form1:tablesPanel:j_id8:TRG3:Stam Google M.U.S.T. Materials Usage Standard Tracking

ATLANTIC PACKAGING

Logout > Dashboard > Select Node > Lines > View Reports xxxxxx

Line 1A

Benchmark

Film: 28.5 x 10000 ..... 50ga.
Top Wraps: ..... 2
Bottom Wraps: ..... 2
Spiral-Up Wraps: .....1.5
Spiral-Down Wraps: .....1.5
Target Rev's/Pallet: ..... 7.0
Target Oz./Pallet: ..... 2.55

Report Time:
04/11/2009 through 05/11/2009

Report Stats:
Avg. Oz./Pallet: ..... 2.33
Total Pallets: ..... 2899

At current usage rate, stretch film consumption is being reduced by pounds per month on this wrapper. Slurce reduction is compared to 2.55 ounces from an Atlantic audit on 4/11/09

View Details ( Pallets)

Line 1A On 5/11/2009 Avg. Oz./Pallet 2.44, Total Lbs. 12.81, Total Pallets ( 84)

Hour 15: Total Pallets 16, Total Lbs. 2.37, Avg. Oz. 2.37

| Time | Ounces | Breaks |
|---|---|---|
| Hour 15: Total Pallets 16, Total Lbs. 2.37, Avg. Oz. 2.37 | | |
| 2009-05-11 14:59:09.0 | 2.3919 | 0 |
| 2009-05-11 14:55:20.0 | 4.7629 | 0 |
| 2009-05-11 14:46:35.0 | 2.371 | 1 |
| 2009-05-11 14:43:42.0 | 2.4022 | 0 |
| 2009-05-11 14:40:59.0 | 2.3919 | 0 |
| 2009-05-11 14:38:05.0 | 2.3605 | 1 |
| 2009-05-11 14:34:52.0 | 2.371 | 0 |
| 2009-05-11 14:07:34.0 | 2.3396 | 0 |
| 2009-05-11 14:01:08.0 | 2.5694 | 1 |
| Hour 13: Total Pallets 14, Total Lbs. 2.23, Avg. Oz. 2.54 | | |
| Hour 12: Total Pallets 20, Total Lbs. 2.98, Avg. Oz. 2.38 | | |
| Hour 11: Total Pallets 15, Total Lbs. 2.23, Avg. Oz. 2.38 | | |
| Hour 10: Total Pallets 10, Total Lbs. 1.49, Avg. Oz. 2.39 | | |

Line 1A On 5/10/2009 Avg. Oz./Pallet 2.4, Total Lbs. 14.72, Total Pallets ( 98)

Hour 16: Total Pallets 1, Total Lbs. 0.14, Avg. Oz. 2.31
Hour 15: Total Pallets 19, Total Lbs. 2.82, Avg. Oz. 2.37
Hour 14: Total Pallets 15, Total Lbs. 2.23, Avg. Oz. 2.38

FIG. 14D

M.U.S.T.
Materials Usage Standard Tracking

Data Paths Web Interface PDF Report

M.U.S.T.
Materials Usage Standard Tracking

XXXXX XXX Stretch Wrap Report
XXXX XXXXXXXXXXXXXX

Production Chart

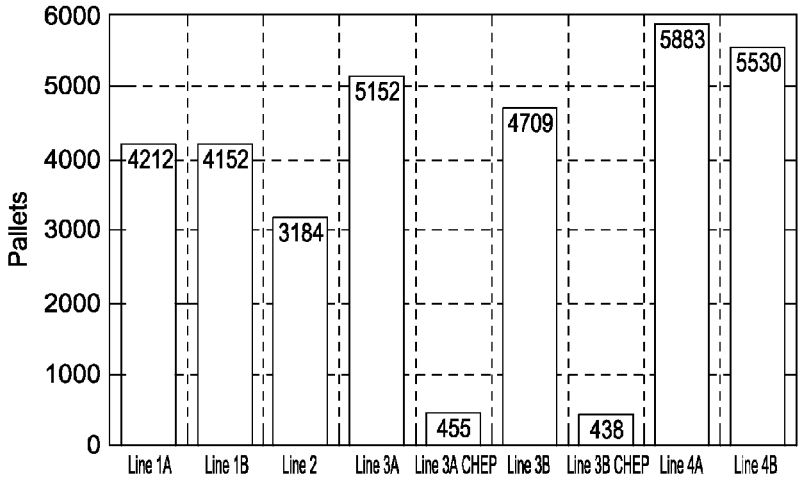

09/28/08 through 10/24/08

| Line | Type | Pallets Wrapped | Price | Extended | Total |
|---|---|---|---|---|---|
| Line 1A | Can Line | 4212 | XXX | XXX | |
| Line 1B | Can Line | 4152 | XXX | XXX | |
| Line 2 | Can Line | 3184 | XXX | XXX | |
| Line 4A | Can Line | 5883 | XXX | XXX | |
| Line 4B | Can Line | 5530 | XXX | XXX | XXX |
| Line 3A | Bottom Line | 5152 | XXX | XXX | |
| Line 3B | Bottom Line | 4709 | XXX | XXX | XXX |
| Line 3A | Bottle CHEP | 455 | XXX | XXX | |
| Line 3B | Bottle CHEP | 438 | XXX | XXX | XXX |
| | | | | | XXX |

ANOTHER ATLANTIC ADVANTAGE

Copyright© 2008 Atlantic Packaging. All Rights Reserved. The M.U.S.T. System is Patent Pending

FIG. 14E

SYSTEMS FOR MONITORING AND CONTROLLING USAGE OF MATERIALS

RELATED APPLICATIONS

The presently disclosed subject matter claims the benefit of U.S. Provisional Patent Application Ser. No. 61/057,059, filed May 29, 2008; the disclosure of which is incorporated herein by reference in its entirety.

TECHNICAL FIELD

Systems for tracking material used to wrap and contain goods are provided. In particular, material usage tracking systems are disclosed herein to accurately measure the amount of stretch film that is applied to individual loads such as products and/or pallets of products.

BACKGROUND

In the past, there have been very few ways to determine the amount of film being used by a stretch wrapping machine. Once a machine is adjusted, there are many reasons that can cause the adjustments to change. When an owner of a stretch wrapping machine sets up the machine, they expect their film costs to stay the same. They expect the stability of their palletized loads to remain the same as well. In reality, machine wear or unauthorized adjustments made by personnel alters both aspects of the machine's functions. Typically, after a short while, the loads will appear to become less stable and the operators will adjust the machine to apply more film to the loads. In turn, this increases the company's film costs as well as increasing the amount of plastic waste in landfills.

In the past, the only way companies would find out about the excessive film costs is when the purchasing department noticed the increase in stretch film purchases. This increase is not, by itself, an indicator of a problem. If the company's productivity increases, the stretch film usage would be expected to increase.

It was possible to perform tests on the package and machines to determine if the machines were performing correctly. These tests would involve testing the containment force of the film (determining how tightly the film was "squeezing" the load) and removing the film from a wrapped pallet and measuring the weight of the film. However, these types of tests were sometimes only performed once or twice a year, if at all.

Thus, a need exists to better monitor and control the use of stretch film. The material usage tracking systems disclosed herein can perform the film weight test after every load is wrapped. The information about the consistency of the stretch wrapping process can be readily available to customers. The material usage tracking systems can be a good way to ensure sustainable packaging stability and costs. The material usage tracking systems also can allow companies to be environmentally conscious and reduce plastic waste that eventually reach landfills.

SUMMARY

It is an object of the presently disclosed subject matter to provide systems for monitoring and optimizing material usage. In particular, material usage standard tracking systems are disclosed herein that accurately measure the amount of stretch film that is applied to individual loads such as products and/or pallets of products as the loads are being wrapped by stretch wrap equipment and compare that value to a specified benchmark value.

An object of the presently disclosed subject matter having been stated hereinabove, and which is achieved in whole or in part by the presently disclosed subject matter, other objects will become evident as the description proceeds when taken in connection with the accompanying drawings as best described hereinbelow.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which:

FIG. 10 illustrates an embodiment of an interactive screen display window of an authentication window for use in an internet web browser interface for a material usage tracking system according to the present subject matter;

FIGS. 11A, 11B, and 11C illustrate embodiments of an interactive screen display window or webpage layout of an organizational overview window for use in an internet web browser interface for a material usage tracking system according to the present subject matter;

FIGS. 12A, 12B, and 12C illustrate embodiments of an interactive screen display window or webpage layout of an location overview window for use in an internet web browser interface for a material usage tracking system according to the present subject matter;

FIGS. 13A, 13B, and 13C illustrate embodiments of an interactive screen display window or webpage layout of a line details window for use in an internet web browser interface for a material usage tracking system according to the present subject matter; and FIGS. 14A, 14B, 14C, 14D and 14E illustrate embodiments of an interactive screen display window, webpage layout, or reports for use in an internet web browser interface for a material usage tracking system according to the present subject matter.

DETAILED DESCRIPTION

Figure 1:
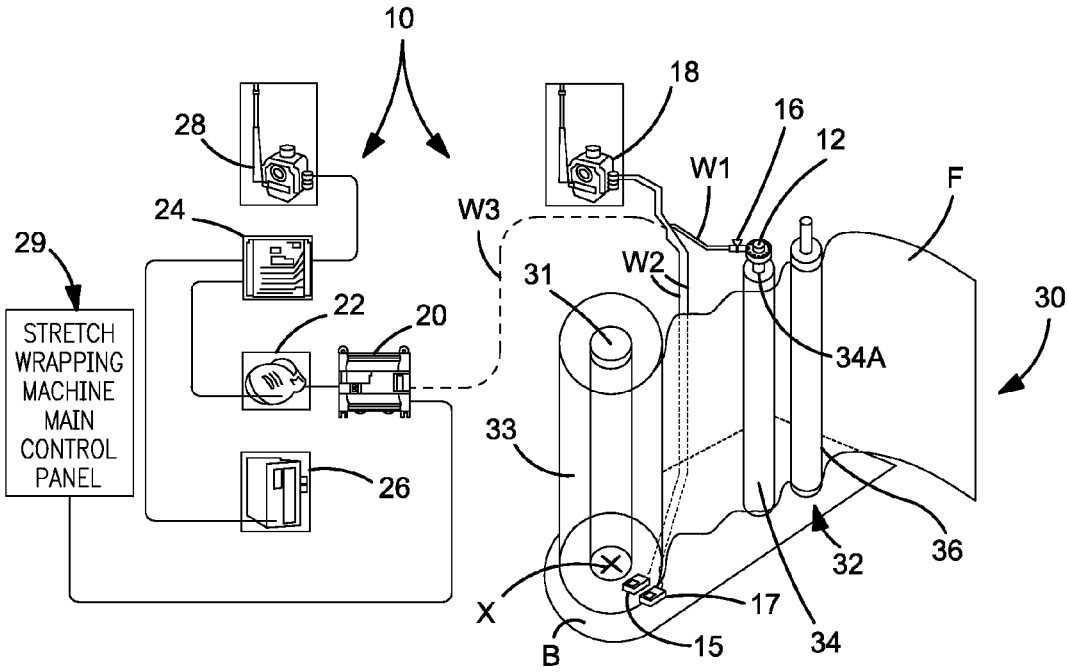
FIG. 1 illustrates a schematic view of another embodiment of a material usage tracking system in use on a film delivery system according to the present subject matter.

Reference will now be made in detail to the description of the present subject matter, one or more examples of which are shown in the figures. Each example is provided to explain the subject matter and not as a limitation. In fact, features illustrated or described as part of one embodiment can be used in another embodiment to yield still a further embodiment. It is intended that the present subject matter cover such modifications and variations.

"Stretch film," "stretch wrap film," or "stretch wrap" as used herein means a highly stretchable plastic film that is wrapped around items with the elastic recovery keeping the items tightly bound. Stretch films are used for overwrapping packaged products, and the unitizing of palletized loads. Normally, the stretch film is supplied from a vertical roll positioned adjacent to the rotating pallet load. Examples of stretch films, their uses, and the machinery on which the films are used, include, but are not limited to, those shown and described in U.S. Pat. Nos. 7,368,160; RE 38,429; and 6,093,480. The description of stretch films, their uses, and the machinery on which the films in U.S. Pat. Nos. 7,368,160; RE 38,429; and 6,093,480 are incorporated herein in their entirety.

"Film delivery system" as used herein means a device the holds a roll of stretchable film and typically through a series of rollers will allow the film to be pulled from the film roll and applied to a product or palletized load.

"Stretch wrapping equipment" or "stretch wrapping machine" as used herein means a machine that wraps stretch film around an item such as a user's product or a palletized load.

The material usage tracking system utilizes structural, sensory, and electronic/electrical components (all of which are referred to herein as "hardware components") to generate different measurements relating to stretch wrap usage. The hardware components can include automatic, semi-automatic, and/or manual inputs to generate and collect these measurements. The measurements generated can include the amount of film used, calculation of film averages per roll of film, recorded film breaks and locations of film breaks, average number of revolutions of wrapping equipment's cycle, amount of film on the film roll not applied to loads, and/or number of pallets wrapped per film roll. The hardware components can also provide alarm notifications such as excessive number of revolutions applied to a load, excessive number of film breaks, and/or film benchmarks not being achieved. Each of the parameter measurements and alarm notifications can be calculated in different manners as described below.

The material usage tracking system also utilizes data collection and analysis components that are used to collect, store, manipulate and present the information received from the hardware components. The data collection and analysis components can include five primary elements. These primary elements can include: Database(s); Data collection element(s); Data Analysis element(s); Notification element(s); and Presentation and Authentication element(s). These elements are described further below.

Different embodiments or implementation configuration of the system can be implemented depending on the user's needs. Depending on the features included in the embodiments, the amount and type of information about film usage provided to the user can vary. Further, how information is transmitted, displayed, and/or recorded can vary depending on the features of the different embodiments.

For example, in a basic embodiment, the system can include a user interface that can display the amount of film used during a wrap cycle on a display panel. This system can be equipped with two colored indicator lights. If the amount of film applied to the load is within the desire benchmark amounts, a green indicator light will flash or illuminate. If the amount of film applied to the load is above the desire benchmark amounts, a red indicator light will flash or illuminate. The user can use these indicator lights and the visual display value to monitor the amount of film applied to their loads. Users can use this basic embodiment on automatic or semi-automatic wrapping machines to control their film costs and sustain the integrity of their loads as well as control the amount of excess film waste going to landfills.

In another embodiment, the system would include a user interface that can display the amount of film used during a wrap cycle on a display panel. This system can be equipped with two colored indicator lights. If the amount of film applied to the load is within the desire benchmark amounts, a green indicator light will flash or illuminate. If the amount of film applied to the load is above the desire benchmark amounts, a red indicator light will flash or illuminate. The system could then calculate the amount of film applied to each load on this wrapper and store this data on a database to be viewed as a history. This information would be available to the user through a touchscreen panel which can be part of the user interface. The user could monitor a short history of the loads wrapped and an overall average of the film applied to the loads. The system can also record and store additional information about the machine's operation. Additional sustainability problems can be monitored and alarms on the touchscreen can record these events when they occur. Additional indicator lights may be installed with this system to notify the user when the desired benchmark specifications are not being met by the machine. Such an embodiment could be used in conjunction with a single automatic machine, for example.

For an operation that employs multiple automatic stretch wrappers, additional features can be added. For example, the system can calculate the amount of film used per load on all stretch wrapping machines and the values from each machine will be stored locally in a data logging station. The system can also be modified to record and store addition information about the machine's operation.

For example, additional sustainability problems can be monitored by the system with the sending of email updates to assigned personnel when the machine's specifications are not correct. Sustainability problems can be monitored and emails can be automatically generated and sent to the designated people. All the data from the machines can be stored on a server, and a complete history of all the machines can be viewed to verify the proper operation of all the machines. This information can be available on the internet with an appropriate password. A user can set the password levels for their employees. A user with multiple locations could assign password levels to each facility so the management at each facility could view their own data, while the corporate office could assign password levels to view all locations being monitored.

The purpose of the material usage tracking system is to accurately measure the amount of stretch film that is applied to individual loads as they are being wrapped by stretch wrapping equipment and to compare that value to a specified benchmark value. The system can inform the customer of the measured results and notify them if this measured value is above the desired benchmark value of the appropriate amount of film necessary to wrap the customer's load. On some material usage tracking systems, the method of billing the customer for the film used may be modified. The intention of this system is to monitor and thereby control the amount of film applied to wrapped loads.

Prior to installation of this system, tests can be performed on the customer's product loads to determine the necessary amount of stretch film to adequately contain their product for shipping. At the conclusion of these tests, this value can become the benchmark for the wrapping application for the customer's product loads.

The types of loads that the stretch wrappers will wrap will vary greatly based upon each user's needs. Some loads being wrapped by these machines are large single components that simply need the protection of the stretch film to protect the product during shipping. Some loads are wrapped to secure the product to a pallet so the product may be transferred with a lift truck. Some loads are a combination of multiple individual products that are placed upon a pallet for shipment. Some loads are a mixture of all these configurations. Whatever the product configuration, most loads require film applied before shipping. Each load will require a certain amount of film to be applied to adequately protect the load during shipment. This specific amount of film is known as a "Benchmark." Any film applied to the load in excess of this benchmark is wasted resources. This waste includes wasted cost and wasted natural resources. This excess film also affects the environment by producing excessive, unnecessary waste being sent to landfills.

This system can use components that can calculate the amount of film being used to wrap a customer's load on existing stretch wrapping equipment. This system can display the amount of film used to wrap each customer load. This value can be compared to a benchmark value automatically depending on the features of the material usage tracking system implemented at the customer's location.

If this recorded value is above the desired benchmark setting's acceptable limits, the customer can be notified of the unacceptable condition so the customer may make appropriate changes to the machinery to get the actual amount of stretch film used per load back into the desired acceptable range. The material usage tracking system can provide customers with the ability to maintain sustainability of the amount of stretch film used on their product to prepare their loads for shipment. This ability can result in sustaining their film costs, sustaining the integrity of the stability of their loads during shipment, and to allow the customer to decrease the amount of stretch film being sent to landfills from their customer's locations.

The system is used to monitor usage of material such as stretch wrap films used for overwrapping packaged products, and the unitizing of palletized loads.

As shown in FIG. 1, a material usage tracking system, generally designated 10, and a film delivery system, generally designated 30 are provided. The film delivery system 30, which can be apart of or on which the material usage tracking system 10 is used, can vary. The film delivery system 30 can include a post mandrel 31 on which a roll 33 of stretch film F can be placed. The film delivery system 30 can also include non-stretch rollers or mechanisms (not shown) that guide the film F as it is applied to the product or palletized loads. The film delivery system 30 also includes a pre-stretch apparatus 32 that can assist in the removal of the stretch film F from the film's roll 33. The pre-stretch apparatus 32 includes a series of rollers 34 and 36 and can include a power mechanism, such as a motor (not shown).

The series of rollers includes a pre-stretch roller 34 and a stretch roller 36. The pre-stretch roller 34 is rotated by the motor at a slower speed than the stretch roller 36. Thus, the pre-stretch roller 34 moves the stretch film F into a stretch zone between the pre-stretch roller 34 and the stretch roller 36. Thus, as the film F rotates around pre-stretch roller 34, the roller 34 does not stretch the stretch film F. The pre-stretch apparatus 32 can include other rollers (not shown) to guide the film between the series of rollers as the film F is applied to the load. Other rollers may also provide a nip with the respective rollers 34 and 36 through which the film F passes. However, such rollers are not required. The pre-stretch apparatus 32 will stretch the film F as it travels through the rollers. By stretching the film F prior to applying to a load, the strength of the film F is increased and the total number of loads being wrapped by a roll 33 of film F is increased while the unit cost of the film per load is reduced.

As discussed above, there are three basic components to a pre-stretch delivery system on most systems. A first pre-stretch roller 34 is used to grip or hold the film during the stretching process of the film F. The film F travels around this roller prior to stretching. The amount of film F traveling around this roller is equal to the amount of film removed from the film roll 33. A second roller, or stretch roller 36, may be equal to, or larger in diameter than, the first pre-stretch roller 34. This roller 36 will turn at a much faster rate or have a much faster surface speed as measured from the surface of the rollers than the first roller 34. This faster speed will cause the film to stretch between the two rollers. Both rollers are designed to grip or hold the film as it stretches. The third basic component of the pre-stretch apparatus 32 is pre-stretch gears (not shown). Each roller 34, 36 is connected to each other with a chain or belt. The ratio of the gears on the two rollers is designed to turn the pre-stretch roller 34 at a much slower speed than the second roller 36 or turn the pre-stretch roller 34 such that the surface speed on the surface of the pre-stretch roller 34 is slower than the surface speed on the surface of the second roller 36. The amount of stretch that is applied to the film F is determined by the difference in the number of teeth on the two sprockets or pulleys.

Figure 2:
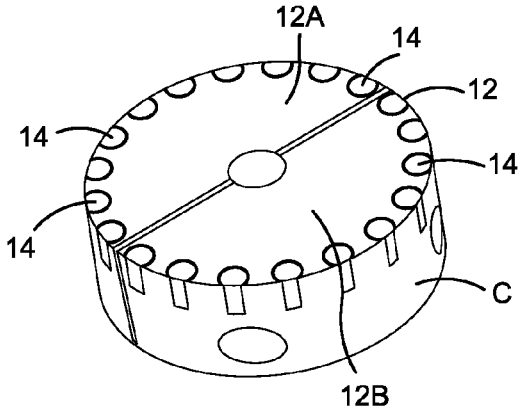
FIG. 2 illustrates a perspective view of another embodiment of a rotary encoder collar according to the present subject matter for use in the material usage tracking system of FIG. 1.
Figure 3:
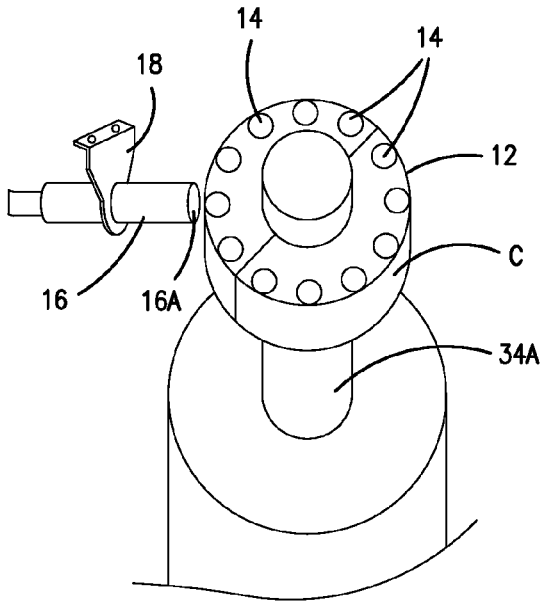
FIG. 3 illustrates a partial perspective view of a pre-stretch roller of the film delivery system in accordance with FIG. 1.

To track the usage of stretch film F, the material usage tracking system 10 can include a rotary encoder collar 12. The rotary encoder collar 12 can be located on the first pre-stretch roller 34 on the machine's film delivery system 30. This rotary encoder collar 12 can be constructed of a non-ferrous material, for example, plastic, aluminum, or the like. The rotary encoder collar 12 can have a plurality of individual steel inserts 14 evenly distributed around its circumference C as shown in FIGS. 2 and 3. For example, six or twelve steel inserts can be evenly distributed around the collar's circumference. A small proximity sensor 16 can be positioned to detect each of the steel inserts as the first pre-stretch roller rotates as shown in FIGS. 1 and 3. For example, if the roller circumference C is twelve inches and the rotary encoder collar 12 has twelve inserts 14, then each time the proximity sensor 16 detects an insert 14 on the rotary encoder collar 12 during rotation of the pre-stretch roller 34, one (1) inch of film F travels through the through the film delivery system 30.

The rotary encoder collar 12 can be installed onto the roller shaft 34A between a top mounting plate (not shown) of the film delivery system 30 and the larger diameter part of the roller 34. The rotary encoder collar 12 can be constructed as a two piece device that is bolted together. When the bolts are removed from the rotary encoder collar 12, the two pieces 12A and 12B can be separated and placed on each side of the roller shaft 34A. With the rotary encoder collar 12 in place on the roller shaft 34A, the collar bolts (not shown) can be replace and tightened. This will lock the rotary encoder collar 12 in place on the roller shaft 34A. With the rotary encoder collar 12 in place, a proximity sensor bracket 18 can be mounted to the film delivery system's top mounting plate (not shown) in such a way that the proximity sensor face 16A is aligned with the steel inserts 14 on the rotary encoder collar 12. The distance from the face 16A of the proximity sensor 16 to the circumference C of the rotary encoder collar 12 should be very large. For example the distance can be under or about 3 mm. This distance is to ensure the steel inserts 14 on the rotary encoder collar 12 are within the sensing distance of the proximity sensor 16.

The proximity sensor's wiring cable W1 can be routed in a path that is protected from damage. Depending on the sophistication of the system, the sensor 16 can be connected to a wireless counter node 18 mounted on the film delivery system 30. For a basic configuration, the sensor 16 can be connected to a counter display module (not shown). Alternatively, the sensor 16 can be hard wired to a controller 20 as shown by dotted line. Controller 20 can be any suitable control mechanism such as a personal computer, a microcomputer, a programmable logic controller ("PLC"), or the like. For example, each stretch wrapping machine can be hard wired to a controller 20 so that the stretch wrapping machine and the controller are in communication.

Figure 4:
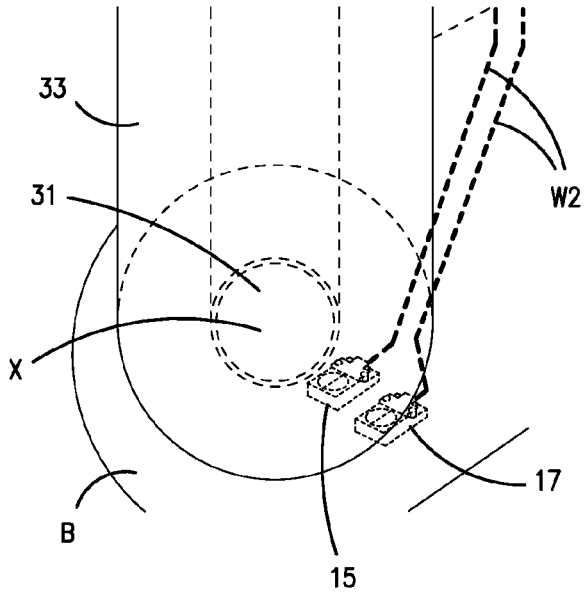
FIG. 4 illustrates a partial perspective view of a stretch film roll residing on a mandrel of the film delivery system in accordance with FIG. 1.

The material tracking system 10 can also include film detection sensors 15, 17 that can be used in embodiments where historical information is collected and stored such as the amount of stretch film F applied to on each load. On the film delivery system, the mandrel post 31 can be provided that is designed to hold the film roll 33 in position for the removal of film F. By design, there is a small space under the roll 33 of film. The film detection sensors 15, 17 are very slim and are capable of being mounted to the film delivery system's bottom mounting plate B under the film roll 33 or mounted above the film roll 33 as shown in FIGS. 1 and 4. The first film detection sensor (empty roll sensor) 15 can be mounted as close to the center X of the roll diameter as possible. The second film detection sensor 17 (Full Roll Sensor) can be mounted as close to the outer diameter of the film roll 33 as possible. The sensing window of the second film detection sensor 17 can be completely under the roll 33 of film F. Again, the wiring cables W2 from both sensors 15, 17 can be routed in a path that is protected from damage. Further, both sensors 15, 17 can be connected to a wireless counter node 18 connected to a data collector, for example, a PLC, mounted on the film delivery system 30 or hardwired to the controller 20.

Also, on material usage tracking systems where historical information is collected and stored, a wireless counter node 18 can be used. These devices 18 are used to transmit the electrical signals from the sensors 15, 16, 17 to the material usage tracking system's controller 20 through node 28 without the need for installing wires. However, as stated above, the sensors can alternatively be hard-wired to the controller 20. The controller 20 can, in turn, be in communication with a central database (not shown—but explained in further detail below). For example, controller 20 can be in connection with the central database through a wireless serial connection or an Ethernet connection, for instance, an Ethernet adapter 22 and Ethernet switch 24. The controller 20 can have an internal database therein that stores data that can then be transferred to the central database or used on-site. A data collection element 26, such as a data logger, can be used to send data from the controller 20 to the central database.

Figure 5A:
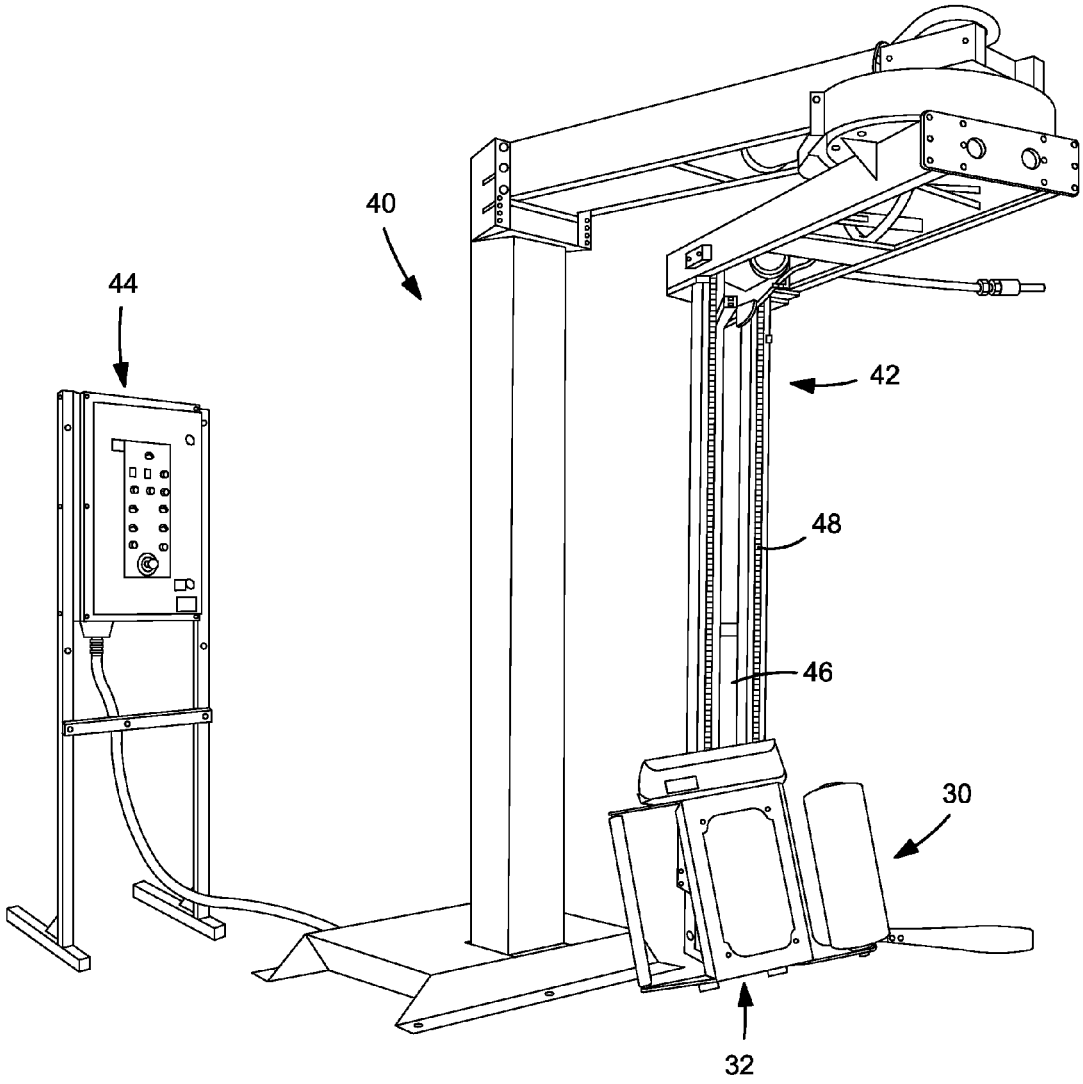
FIG. 5A illustrates a perspective view of an embodiment of a semi-automatic stretch wrapping machine employing a material usage tracking system according to the present subject matter.

Many stretch wrapping machines 40 have the film delivery system 30 on a rotary arm 42 as shown in FIG. 5A that revolves around a stationary load. In many cases, there are no spare wires available on the electrical rings installed on the machine to pass electricity to the moving components of the machine. Referring back to FIG. 1, the use of a wireless transceiver 18, 28 eliminates the need for costly and time consuming modifications to the machine. This module of the wireless transceivers 18 contains a counter input that will count the pulses from the proximity sensor 16. This node 18 stores the accumulated count of all the pulses and transmits the total count to the material usage tracking system's controller 20. This method is designed to prevent any possible missed pulses due to the wireless interface.

As depicted in FIG. 1, a main control panel 29 for the stretch wrapping machine can be in communication with the controller 20. For example, the controller 20 can collect information from the main control panel 29 for the stretch wrapping machine. In some embodiments, the controller 20 can be physically attached to or incorporated into the control panel 29. In such embodiments, the control panel 29 can include the items such as the controller 20, HMI/data logger 26, a wireless network card driver (not shown) such as a Gateway Pro from Gateway, Inc. located in Irvine, Calif., a power supply (not shown) such as a 24 vdc power supply, a Ethernet switch 24, a network adapter 22, a receptacle and an optional uninterruptible power supply (not shown). In other embodiments, the controller 20 can be separate from the control panel 29. Further, the controller 20 can incorporate HMI/data logger 26 or other data transferring device, a wireless network card driver, a power supply, the Ethernet switch 24, the network adapter 22, and the transceiver node 28 such that the controller 20 performs all these functions.

As described above, the controller 20 can be configured to be in communication with the stretch wrapping machine to collect data therefrom. For example the controller 20 can be in communication and/or installed in the control panel of the stretch wrapping machine (for example, control panels 44, 54, 64, and 74 of the respective stretch wrapping machines 40, 50, 60, and 70). Through these connections with the control panel information from the stretch wrapping machines can be shared and utilized by the controller 20. For example, the controller 20 can be configured to detect the number of revolutions of at least one of a turntable or a rotatable arm of the stretch wrapping machine to wrap a product or palletized load.

The controller 20 can also be configured to detect when a top of the product or palletized load is having top and/or bottom wraps applied thereto. In such a configuration, the controller 20 can be configured to detect the number of revolutions of at least one of a turntable or a rotatable arm of the stretch wrapping machine to wrap the top and/or the bottom of the product or palletized load. The controller 20 can be configured to detect when the stretch wrapping machine completes a wrap cycle. Additionally, the controller 20 can be configured to count the number of products or palletized loads wrapped per stretching wrapping machine and/or the number of time the film breaks during the pallet's wrap cycle. The controller 20 can be configured to detect a wrap pattern when multiple wrap patterns are applied by the stretch wrapping machine. Such information can come from the control panel of the stretch wrapping machine which can share this data with the controller 20, which, in turn, can pass the data to the central database as desired.

There are other data and information that controller 20 can detect, count, or calculate that can be stored on the controller for data collection and then send to the central database for further processing. For example, the controller 20 can detect when the film roll is changed. The controller 20 can also count the number of pallets wrapped per film roll. The controller 20 can count the number of pallets wrapped on the machine. The controller 20 can calculate the weight of the film applied to the pallet during the wrap cycle. The controller 20 can also detect the top and/or bottom wrap count setpoint value entered by the machine operator.

The material usage tracking system can also be used to monitor the performance of the operators. On some wrappers, there are devices, such as selector switches, potentiometers, thumb wheels, and other similar input devices that each wrapping machine uses to determine how to apply the film to the pallets. These devices control the machine's motor speeds, rotation counts, and other controls. This option would monitor each of these devices and the values that they send to the machine's PLC's. This option would record the status of these devices with each pallet's data. This, as with every other piece of data recorded, would allow the user to know what changed on the machine to increase their film costs. Thus, the controller 20 can detect the position of the film tension potentiometer. The controller 20 can detect the position of the carriage up and down speed potentiometers as well as the position of the rotation speed potentiometer.

Other examples include that the controller 20 can further record all the above values to a database for each pallet wrapped. The controller 20 can record the date and time of each pallet wrapped. The controller 20 can record the film roll width that the machine is applying to the pallet by entering it on the controller touchscreen. The controller can also store the recorded pallet wrap cycle data.

Figure 5B:
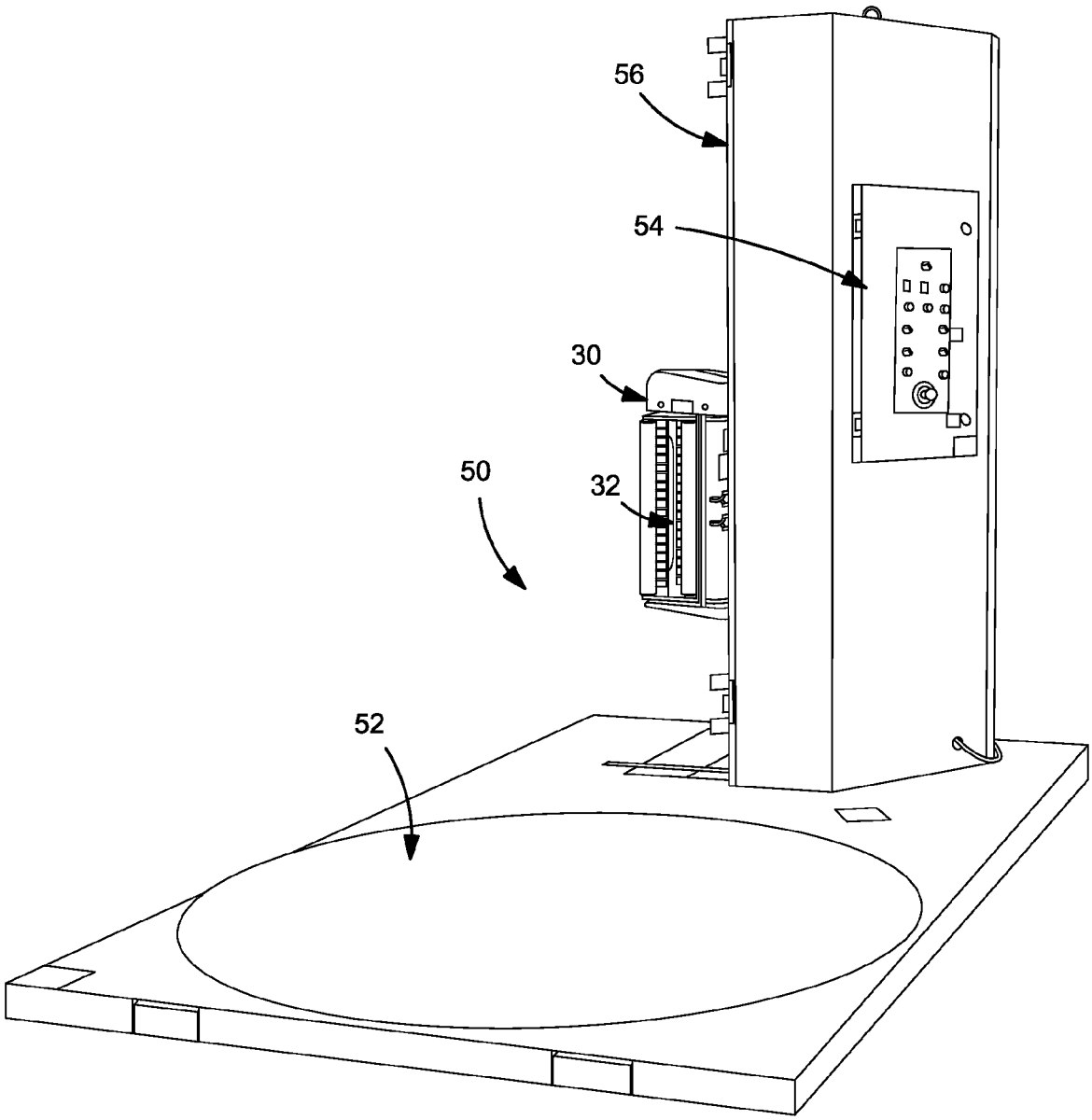
FIG. 5B illustrates a perspective view of an embodiment of a semi-automatic stretch wrapping machine employing a material usage tracking system according to the present subject matter.
Figure 6A:
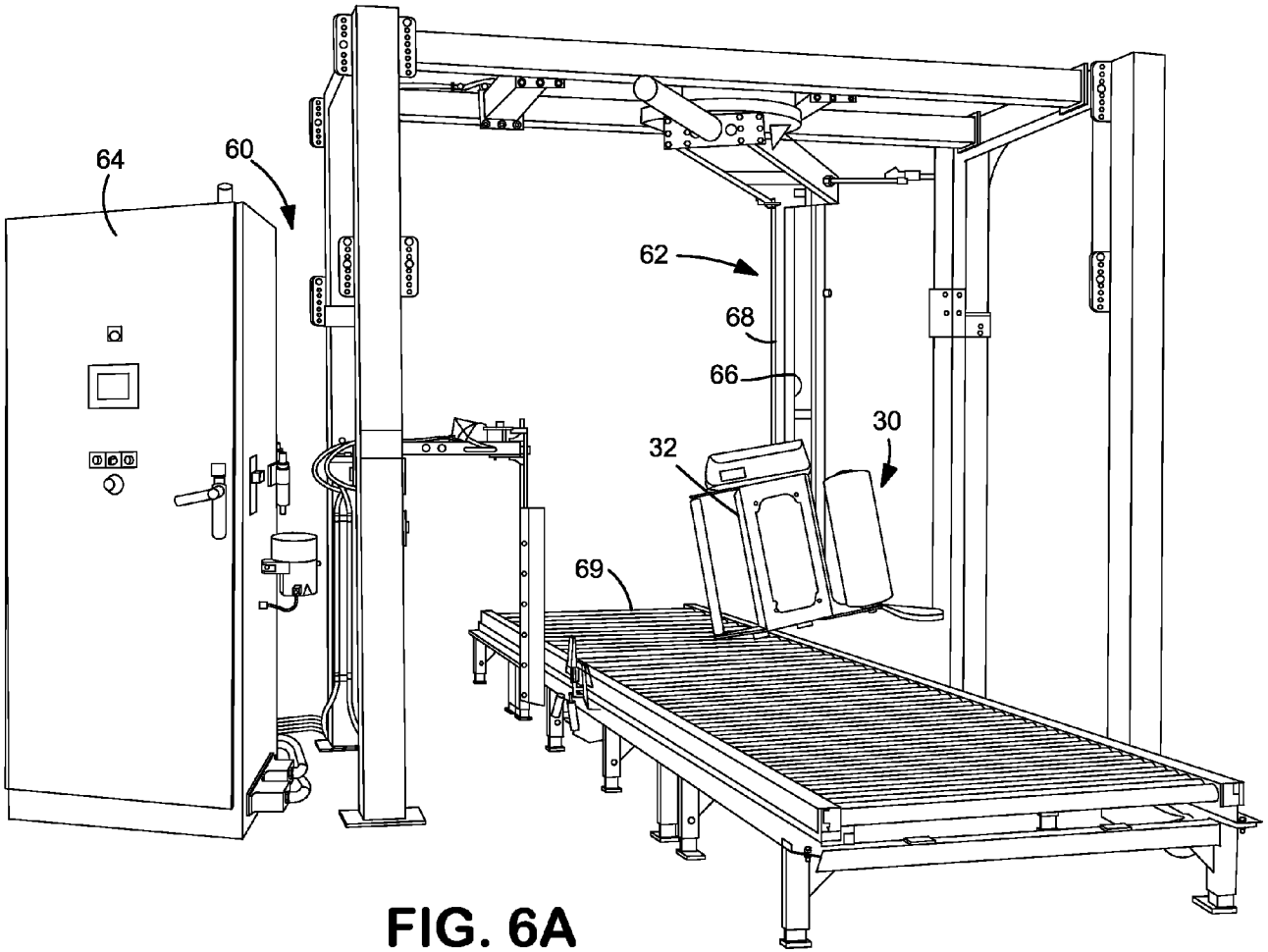
FIG. 6A illustrates a perspective view of an embodiment of an automatic stretch wrapping machine employing a material usage tracking system according to the present subject matter.
Figure 6B:
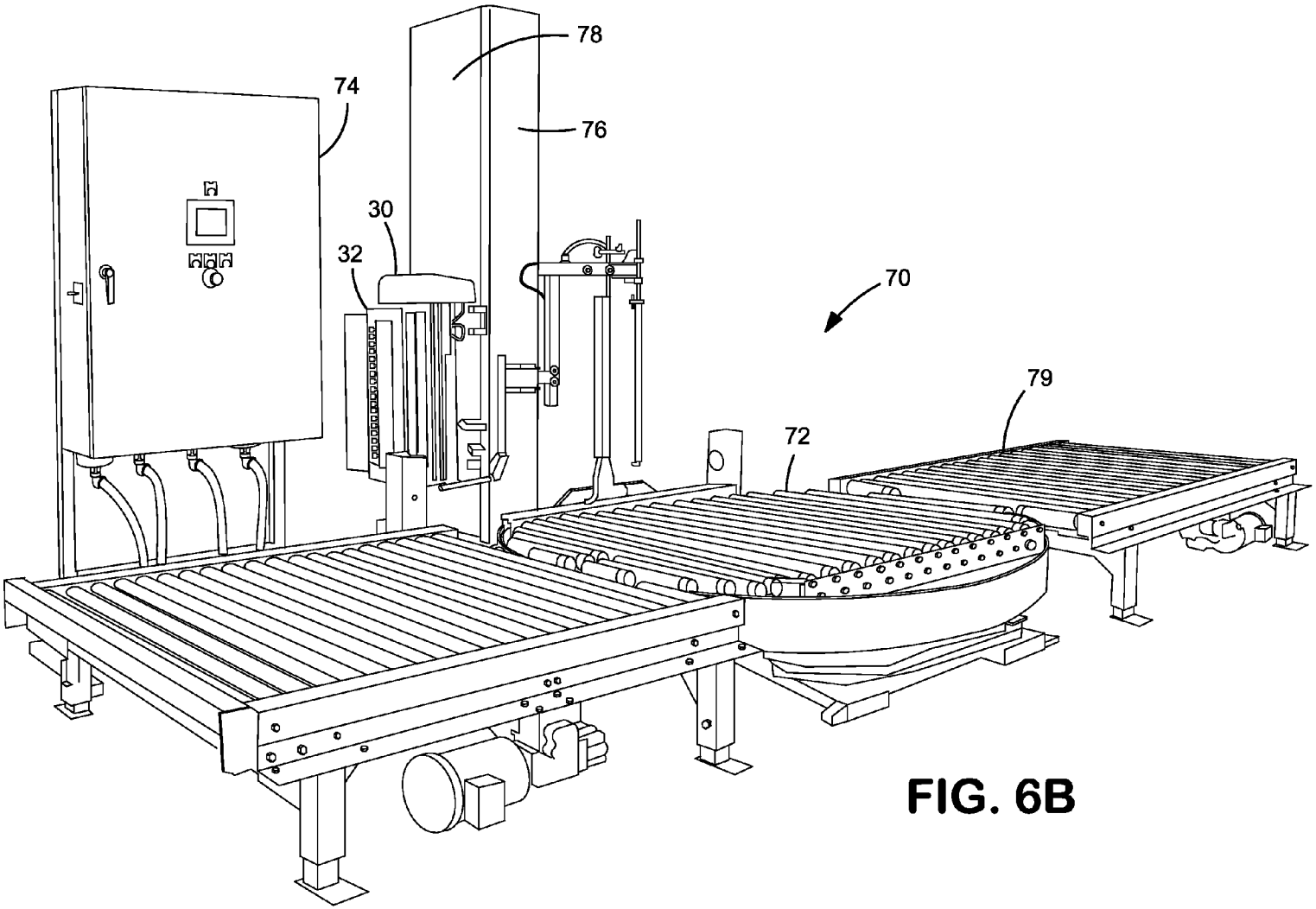
FIG. 6B illustrates a perspective view of an embodiment of an automatic stretch wrapping machine employing a material usage tracking system according to the present subject matter.

The material usage tracking system 10 can be used on different types of stretch wrapping equipment. Such machines wrap film around a product or a palletized load. The reason for wrapping film around a user's product or palletized load can include to provide containment of multiple products to one individual unit for shipping purposes; to provide a containment force to the products on the palletized load to prevent individual products from falling off a load during shipment; to allow a uniform appearance of the product; and to contain multiple individual items to be shipped to a customer in one contained unit. Examples of different types of stretch wrapping equipment are shown in FIGS. 5A, 5B, 6A and 6B. These stretch wrapping machines include semi-automatic stretch wrapping equipment as shown in FIGS. 5A and 5B, and automatic stretch wrapping equipment as shown in FIGS. 6A and 6B.

For semi-automatic stretch wrapping equipment, the machinery is partially automatic and partially hand controlled to apply plastic film to a palletized load of product or other similar product to prepare the product for shipment. The functions of the machinery are normally operated automatically, but it requires an operator to complete the film application process. The types of semi-automatic machine and the portion of those machines that are automatic can vary.

For example, the rotation of the user's product or palletized product and/or the rotation of the film delivery system around the customer's product or palletized product can be automated. For example, as shown in FIG. 5A, a stretch wrapping machine 40 can include a control panel 44 and a rotary arm 42 that has a film delivery system 30 that employs a pre-stretch apparatus 32 as described above with a material tracking system including a rotary encoder collar on the first pre-stretch roller and a controller in control panel 44 of the stretch wrapping machine 40. The movement of the film delivery system 30 to the top of the user's product or palletized product can be automated so that the film delivery system 30 travels along the track 46 and belt or chain 48 in arm 42.

In FIG. 5B, a stretch wrapping machine 50 can include a turntable 52 and control panel 54. Instead of the rotary arm rotating the film delivery system, in this embodiment, the turntable 52 rotates the product or palletized load to wrap it. The stretch wrapping machine 50 has a film delivery system 30 that employs a pre-stretch apparatus 32 as described above with a material tracking system including a rotary encoder collar on the first pre-stretch roller and a controller in control panel 54 of the stretch wrapping machine 50. As the turntable 52 turns the load, the film delivery system 30 travels up and down a tower 56 in which is the control panel 54. The movement of the film delivery system 30 to the top of the user's product or palletized product can be automated so that the film delivery system 30 travels up tower 56. In some embodiments, the stopping the machinery after the desired number of revolutions has been applied to the product or palletized product can be automated. Further, the desired amount of tension of the stretch film applied to the product or palletized product can be automated.

Similarly, the types of semi-automatic machinery and the portion of those machines that are operator controlled, i.e., hand-controlled can also vary. For example, the loading the product or palletized product onto the machinery can be performed by the operator or under the operator's control. For instance, the loading can be performed by manually stacking the product on the machinery. Alternatively, the product or palletized product can be placed on the machinery by a manually controlled transfer device, such as a pallet jack. Further, the product or palletized product can be placed on the machinery by the use of a transfer vehicle, such as a lift truck.

In another example, the attaching of the film from the film delivery system onto the product or palletized product can be performed by the operator. Similarly, the start of the wrapping process can be performed by the operator by initiating a device such as a pushbutton or a pull-cord.

Examples of semi-automatic stretch wrapping equipment include the stretch wrapping equipment and film delivery systems and their uses as shown and described in U.S. Pat. Nos. 3,867,806; 4,050,221; 5,570,564; 4,502,264; and 4,248,031, which are incorporated herein in their entirety.

For automatic stretch wrapping equipment, the machines can generally spirally wrap a continuous sheet of film around a product or palletized load. These types of machine usually contain one or more automatic conveyors that will move the product or palletized load into and out of the stretch wrapping equipment. This type of equipment is designed to function normally without operator assistance. Such automatic stretch wrapping equipment is normally controlled by a programmable controls system.

As shown in FIG. 6A, an automatic stretch wrapping machine 60 can include a rotary arm 62 and a control panel 64. The rotary arm 62 has a film delivery system 30 that employs a pre-stretch apparatus 32 as described above with a material tracking system including a rotary encoder collar on the first pre-stretch roller and a controller in control panel 64 of the stretch wrapping machine 60. The stretch wrapping machine 60 also includes automated material handling equipment in the form of driven conveyor 69. To wrap a load, the product or palletized load is moved down the conveyor 69 into a position where rotary arm 62 along with the film delivery system 30 rotates around the product or palletized load. The movement of the film delivery system 30 to the top of the user's product or palletized product is automated so that the film delivery system 30 travels along the track 66 and belt or chain 68 in arm 62.

In FIG. 6B, an automated stretch wrapping machine 70 can include a turntable 72 and control panel 74. Instead of having a rotary arm rotating the film delivery system, the turntable 72 rotates the product or palletized load to wrap it. The stretch wrapping machine 70 has a film delivery system 30 that employs a pre-stretch apparatus 32 as described above with a material tracking system including a rotary encoder collar on the first pre-stretch roller and a controller in control panel 74 of the stretch wrapping machine 70. The stretch wrapping machine 70 also includes automated material handling equipment in the form of driven conveyor 79. To wrap a load, the product or palletized load is moved down the conveyor 79 into a position where the turntable 72 turns the load as the film delivery system 30 travels up and down a tower 76 in which is the control panel 74. The movement of the film delivery system 30 to the top of the user's product or palletized product is automated so that the film delivery system 30 travels up a track 78 in the tower 76.

In these examples, the product or palletized load is automatically transferred by one or more conveyors into and out of the stretch wrapping equipment as shown in FIGS. 6A and 6B. The load is positioned in the wrap area so the stretch film can be applied. Once the load is in position on the conveyor, the wrap cycle can begin. The film can be attached to the machine's turntable. The machine's turntable can begin to rotate. When the turntable turns, the film is pulled through the film delivery system.

As the load rotates, the film delivery system will elevate to the top of the load. The film will be applied in a spiral pattern to the pallet as the system moves upward. Once the film is at the top of the load, the load can rotate a specific number of revolutions applying multiple layers of film to the top of the load. When the pre-determined number of layers has been applied to the top of the load, the film delivery system can move down. As the system moves to the bottom of the load, the film is applied in a spiral pattern to the middle of the load. Once the film is at the bottom of the load, the load can rotate a specific number of revolutions applying multiple layers of film to the bottom of the load. When the pre-determined number of layers has been applied to the bottom of the load, the turntable will slow down and return to its home position. The end of the film can be automatically clamped to the turntable. After application, the film can be cut and the film tail will be pressed up against the load. The load can then be transferred out of the wrapping area and the machine can await a new load for wrapping.

The automatic stretch wrapping equipment is normally setup to apply a certain amount of film to each load that is wrapped. As long as the machine's parameters remain the same, equal amounts of film are applied to each pallet. The automatic stretch wrapping equipment can have different sustainability problems that can affect the amount of film applied to each pallet.

One major problem can be the changing of settings. There are many parameters on most automatic stretch wrapping equipment that can be modified by an employee of the user. An unauthorized person could make changes to the machine's settings and cause excessive film to be applied to the loads. Often, when this happens, the machine will operate at the higher film amounts for extended periods of time. An example of the settings that could be changed that could affect the amount of film applied to the loads includes the desired number of revolutions at the top and/or bottom of the load. Another example of the settings that could be changed includes the speed of the turntable in relation to the speed of the roll carriage which elevates the film delivery system. For instance, if the turntable is sped up, more film is applied. A further example of the settings that could be changed includes the speed of the film delivery system when it moves in either up direction or down direction. Typically, the slower the film delivery system moves, the more film is applied to the load. An additional example of the settings that could be changed includes the position of the sensor that detects the top of the product or palletized load. This could cause more film being applied to the loads.

Film breaks are another sustainability problem. If and when the film breaks on most automatic stretch wrapping equipment, the system will stop until an operator to reattach the film to the turntable. The system is then restarted. When this occurs, extra layers of film are applied to these loads. If there are consistent occurrences of film breaks, the amount of film to the pallets will increase.

Machine component failures and/or excessive wear are another sustainability problem. There are components on all automatic stretch wrappers than will, over time, experience excessive wear. Many times these worn components will cause more film to be applied to the loads as the machine wraps the product or palletized loads. Often these worn components will break or fail to operate as designed. These failures also can increase the amount of film applied to the loads.

Examples of automatic stretch wrapping equipment include the stretch wrapping equipment and film delivery systems and their uses as shown and described in as shown and described in U.S. Pat. Nos. 5,027,579; 4,979,358; 4,050,221; 4,077,179; 4,232,501; and 4,317,322, which are incorporated herein in their entirety.

Figure 7:
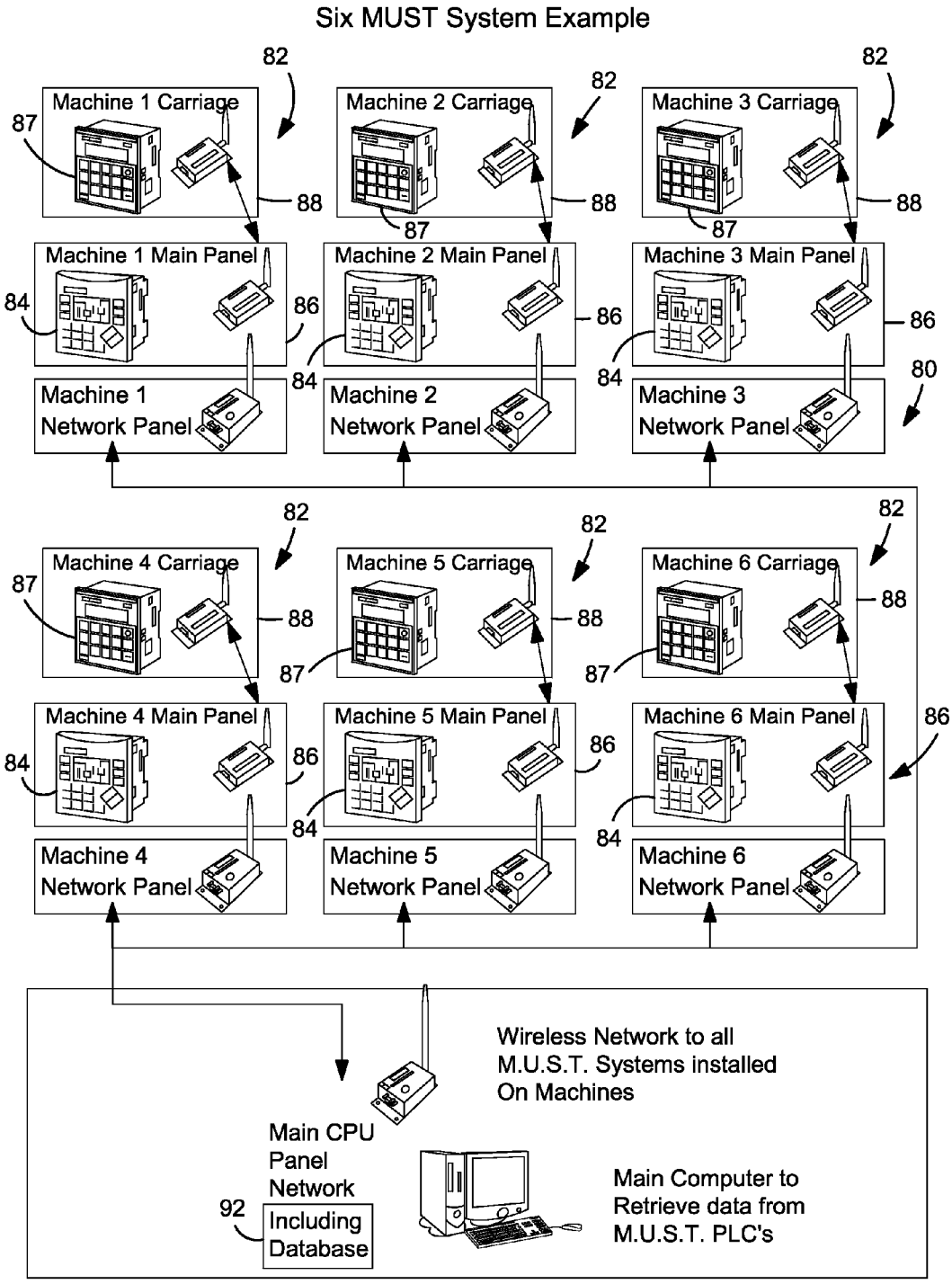
FIG. 7 illustrate a schematic view of an embodiment of a material usage tracking system according to the present subject matter.

FIG. 7 illustrates a schematic drawing of a material usage tracking system 80 for monitoring and optimizing usage of stretch film used in conjunction with multiple stretch wrapping machines 82 used to wrap products or pallets of products. The material usage tracking system 80 includes a plurality of rotary encoder collars as illustrated in FIGS. 1-4. Each rotary encoder collar can be configured to be securable to a pre-stretch roller of a respective stretch wrapping machine 82. The material usage tracking system 80 also includes a plurality of proximity sensors. Each proximity sensor can be configured for placement proximate to a respective rotary encoder collar. Upon installation, each proximity sensor can also be configured to measure the revolutions of the pre-stretch roller of the respective wrapping machine 82 based on the rotation of the rotary encoder collar when the respective stretch wrapping machine 82 is wrapping a product or palletized load.

The material usage tracking system 80 also includes a plurality of controllers 84. Each controller 84 is in communication with a control panel 86 of the corresponding stretch wrapping machine 82. Each control panel 86 in turn is in communication with a machine carriage 88 of the corresponding stretch wrapping machine 82 such that the respective control panel 86 controls the operation of the machine carriage 88. The communication connections between the controllers 84 and the control panels 86 can be hardwired or wireless. In fact, the controllers 84 can be physically attached to the respective control panels 86.

The material usage tracking system 80 can include local control devices 87 that can be secured on the film delivery systems on the machine carriages 88. Each local control device 87 can monitor the sensors on the respective film delivery system and collect data from those sensors. For example, each local control device 87 can count the pulses generated by the respective sensor, briefly store it and then forward the data to the respective controller 84. Thus, for example, the local control devices 87 can be on the rotary arms 42, 62 of the wrapping machines 40, 60 depicted in FIGS. 5A and 6A or on the film delivery systems 30 on the towers 56, 76 depicted in FIGS. 5B and 6B. The local control devices 87 can comprise a PLC for collecting information and a transceiver for communicating the information to the respective controllers 84. The communication connections between the local control devices 87 and the controllers 84 can be hardwired or wireless.

Each controller 84 receives the data from the local control devices 87. The controller 84 is configured to convert the revolutions of the corresponding pre-stretch roller into a measurement of the amount of stretch film pulled off a stretch film roll in the respective stretch wrapping machine based on data received from the proximity sensor.

Each controller 84 can be configured to access a benchmark value for an amount of stretch film that is expected to be used for the type of product or pallet being wrapped. The benchmarked value can be stored on controller 84 or some other database to which the controller 84 has access. Each controller 84 is also configured to compare the measurement of the amount of stretch film pulled off the stretch film roll to the benchmark value. In this manner, the controller 84 can determine if the corresponding stretch wrapping machine 82 is operating properly.

The material usage tracking system 80 further includes a central database 92 that is a part of a central CPU panel network 90. The database 92 is in communication with each of the plurality of controllers 84. The central database 92 collects and stores data from each controller 84. The data stored on the central database 92 can be analyzed to provide information to monitor and optimize each stretch wrapping machine 82 or the specific location or organization that uses the material usage tracking system 80.

In some embodiments, there can be an intermediate retrieval and store CPU such as a computer. In such embodiments, the data from all the stretch wrapping machines 82 are send and temporarily stored on the intermediate computer. For example, data can be transferred from the controllers 84 to the intermediate computer through a wired connection or a wireless connection. Then, periodically, the data stored on the intermediate computer can be uploaded into the central database 92. For example, data can be transferred from the intermediate computer to the central database 92 through a wired connection or a wireless connection. For example, the data can be transferred through a telephone service or a cellular connection.

I. Information Recorded

The material usage tracking system when employed on the different stretch wrapping equipment can eliminate and/or minimize the excessive usage of the stretch film by monitoring the use of the stretch film to prevent or alert users to these and other problems.

For example, the material usage tracking system can provide different measurements depending on the features of the system employed and the type of equipment on which it is used. The following are different parameters that can be measured or types of information that can be collected by the material usage tracking system.

I. A. Measurement of Film Used

The material usage tracking system can utilize hardware components described above to measure the amount of film that moves through the film delivery system. As the first pre-stretch roller turns, the film that moves around that roller is non stretched film. The film moves around the circumference of the roller. For every revolution of this roller, the amount of film that travels around this roller is equal to the circumference of that roller. For example, if the circumference is 10 inches, then there will be 10 inches of film move through the film delivery system for every revolution of the first pre-stretch roller.

Since the amount of film moving through the film delivery system is known to be equal to the circumference of the first pre-stretch roller, the amount of film can be measured. Measuring the film is performed by determining the number of revolutions of the first pre-stretch roller. As in the example given above, if the circumference of the roller is 10 inches, then one revolution of this roller will equal 10 inches of film. In most embodiments, the accuracy of the material usage tracking system can have a higher resolution than measuring the film every 10 inches through the use of the rotary encoder caller that is placed on the shaft of the pre-stretch roller.

As described above, the collar is placed around the shaft of the first pre-stretch roller. This rotary encoder collar is constructed of a non-ferrous material, for example, plastic, aluminum, or the like. The rotary encoder collar can have a plurality of individual steel inserts evenly distributed around its circumference. For example, 6 or 12 steel inserts, referred to as contact points, can be evenly distributed around the collar's circumference. The small proximity sensor can be positioned to detect each of the steel inserts as the first pre-stretch roller rotates. For example, if the roller circumference is 12 inches and the rotary encoder collar has 12 contact points, then each time the proximity sensor detects a contact point on the rotary encoder collar during rotation of the pre-stretch roller, one (1) inch of film travels through the film delivery system.

As the stretch wrapping equipment applies film to the product or palletized load, the proximity sensor detects the contact points of the rotary encoder collar for the entire wrapping cycle of the stretch wrapping equipment. The Programmable Logic Controller (PLC) connected to the proximity sensor will count the total number of pulses from the inserts detected and multiply this value by the know distance of film per insert. This value will represent the number of inches of film applied to the load. This value can be then divided by 12 to determine the number of feet of film that is applied to each wrapped load.

I. B. Calculation of Film Averages Per Roll of Film

Apart from determining the amount of film applied to each load, the material usage tracking system can determine the number of loads that are wrapped by each roll of film. This number of loads wrapped per roll of film is used to verify the measurement of film per load is accurate. This information is useful, for example, when there are circumstances that could allow the film to slip around the pre-stretch roller. If this slippage does occur, the actual amount of film moving through the film delivery system may be slightly less that the circumference of the first pre-stretch roller.

Determining the average film weight per load using this method and comparing that value to the measure film weight per load will allow the system to check for machine wear and/or failures. If the amount of film per load is expected to be about 2.5 oz per load and the film roll has about 872.5 oz of film, then the expect number of loads wrapped by that roll should be about 349 loads.

There are several reasons why this number will be less than 349. For example, film breaks will cause some pallets to have more film applied than the benchmark. The material usage tracking system will look at the number of film breaks on the roll and take that into consideration when making the film weight average comparisons. Another reason can include damaged film rolls. If the film rolls are damaged prior to installation on the machine, the operators will remove the damaged film from the roll prior to starting the wrap cycle. Damaged film will normally not move through the pre-stretch rollers without breaking. The damaged film will cause a high number of film breaks and will tremendously slow the machines ability to wrap loads. Further, there are times when operators will remove a roll of film before the film has been completely removed from the roll. This is not a normal condition and film rolls should not be removed early. Often times this unused film is thrown away.

The average film weights per load using this method of calculation are monitored for specific patterns. If there is an occurrence of a low number of loads wrapped by a roll of film, this number is compared to the numbers of loads wrapped previously on that stretch wrapping equipment. An occasional anomalous calculation would normally infer that an operator has removed damaged film from the roll or that the roll of film was removed early from the machine. Repetitive anomalous calculations would infer that there was a problem with the film delivery system that was allowing the film to slip through the pre-stretch rollers. The material usage tracking system could then notify the proper personnel, such as the maintenance department of the user, and request servicing of the stretch wrapping equipment. The notification could provide specific information to the customer as to the potential problem and the possible methods needed to correct the problem.

Each type and gauge of film has some specific parameters. The film installed on the machines when the material usage tracking system is installed can be recorded in the database. When a new roll of film is installed on the machine, the material usage tracking system calculates an average film weight. The known weight of the film roll is divided by the number of loads wrapped on the machine for that roll. This number is compared to the film measurement to check for accuracy.

I. C. Recorded Film Breaks and Locations of Film Breaks

During the wrap cycle of a stretch wrap machine, the film being applied to the load can tear or break. Normally, the machine will detect this condition and stop the wrap cycle. The machine will normally wait for an operator to re-attach the film to the machine and restart the wrap cycle. There are many reasons why film breaks can occur. Such reasons can include mishandling of the film roll, machine problems, quality issues with the film, loads that have sharp edges that cut or tear the film, and loads that are smaller than the pallet and the corners of the pallets tearing the film. Many other reasons not mentioned here also exist that a person of ordinary skill in the art would recognize.

Knowing when the film breaks during the wrap cycle is important when trying to determine the cause of the film breaks. If the film breaks consistently at the same point or time of the wrap cycle, the problem is usually caused by a specific reason. Multiple film breaks that happen at random times throughout the wrap cycle usually infer that there is a problem with the film or with the film delivery system.

The material usage tracking system can monitor when the film breaks occur during the wrap cycle. For example, the material usage tracking system can count the number of film breaks that occur in six different times or during six different basic events of the wrap cycle. These six example events are as follows.

I. C. 1. Film Breaks at the Film Clamp

Film breaks that occur at the start of the wrap cycle usually infer a problem with the stretch wrapping equipment's clamping device that holds the film before it is applied to the load. For example, if this device fails, the film will either break or pull out of the clamping device, resulting in a film break. The material usage tracking system can record the occasions when the film breaks during this event.

I. C. 2. Film Breaks while Carriage Moves to Top of Load

After the film is applied to the bottom of the load, the carriage will move the film delivery system to the top of the load. The material usage tracking system can record the occasions when the film breaks during this event.

I. C. 3. Film Breaks while Applying Top Wraps

When the film delivery system reaches the top of the load, the stretch wrapping equipment will begin applying film to the top of the load for a specific number of revolutions. The desired number of revolutions is determined on each machine during the benchmark testing. The material usage tracking system can record the occasions when the film breaks during this event.

I. C. 4. Film Breaks while Carriage Moves to the Bottom of the Load

When the desired number of revolutions at the top of the load is complete, the film delivery system will move to the bottom of the load. The material usage tracking system can record the occasions when the film breaks during this event.

I. C. 5. Film Breaks while Applying Bottom Wrap Counts

When the film delivery system reaches the bottom of the load, the stretch wrapping equipment will begin applying film to the bottom of the load for a specific number of revolutions. The desired number of revolutions is determined on each machine during the benchmark testing. The material usage tracking system can record the occasions when the film breaks during this event.

I. C. 6. Film Breaks at the End of the Wrap Cycle

When the desired number of revolutions at the bottom of the load is complete, the stretch wrapping machine will move all components to their starting positions and stop. The material usage tracking system will record the occasions when the film breaks during this event.

I. C. 7. Method of Calculation of Film Breaks

The initial benchmark testing of the load to be wrapped can determine the desired amount of film to be placed on the load. During the installation of the material usage tracking system, each stretch wrapping machine can be adjusted and the machine's parameters adjusted to set the machine to apply the benchmark amount of film per load. When the machine is adjusted correctly, the material usage tracking system can determine the desired number feet of film to be applied to the load.

The distance of the un-stretched film used on each load can be determined during the installation of the material usage tracking system. The number of revolutions of the customer's load can also be determined by the benchmark testing. For example, if the benchmark amount of film for each load equates to about 25.78 feet, and the desired number of revolutions of the machine equates to seven (7), then the number of feet of film applied to each revolution of the machine would be about 3.68.

The material usage tracking system can monitor the proximity sensor that detects the rotary encoder collar for movement. If the proximity sensor is detecting the contact points on the rotary encoder collar, the system knows that film is being moved through the film delivery system. If the proximity sensor stops detecting the contact points during the machine's wrap cycle, the system knows that film has stopped moving through the film delivery system. If the film is no longer being applied to the load and the machine has not completed the entire wrap cycle, the material usage tracking system detects a film break.

The material usage tracking system can measure the amount of film used during the wrap cycle, and the system can determine how many feet of film are used for each revolution. If the system detects a film break, the number of feet applied to the pallet prior to the film break will allow the system to determine what the machine was doing at the time of the film break. For example, if the film breaks during the $3^{rd}$ revolution of the machine and the material usage tracking system determines that stretch machine is applying the top layers of film during the $3^{rd}$ revolution, then the system can record that the film break occurred while the top wraps were being applied to the load.

I. D. Average Number of Revolutions

As described above, the benchmark testing of the loads can determine the desired number of revolutions of the machine for each load. The material usage tracking system calculates the number of feet applied to the load during each revolution. If some setting on the machine is modified and the machine applies more revolutions than the desired benchmark, the system can record this event. The material usage tracking system can then average the number of revolutions applied to all the loads wrapped by the current film roll.

The material usage tracking system can calculate the total feet of film applied to all the loads wrapped from the installed roll of film and can divide that number by the total number of loads wrapped. This value will show the average feet of film used per load. This value can then be divided by the known number of feet of film used per machine revolution to determine the average number of revolutions per pallet.

I. E. Amount of Film on Roll not Applied to Loads

Each roll of film has a specific amount of film on the roll. Generally, the film rolls are manufactured by weight, not feet, of the film. However, the number of feet of film on each roll will be very close to the same amount on each roll. There are many factors that determine the number of feet on each roll of film. Some of these factors include the brand or manufacture of the film, the gauge of the film, and the width of the roll of film, the overall weight of the full roll of film, and sometimes, the customer's specifications as to the weight of the roll.

If, for example, a roll of film has 9000 feet of film, the expected usage of the film on a stretch wrapper should be 9000 feet of film applied to the loads. There are some possible events that will decrease the amount of stretch film actually applied to the loads. These events are anomalous and varied. Thus, they should not occur on a normal basis. For example, many of them are caused by people removing film from the roll manually. Many of them are caused by people removing the roll of film from the machine before the film roll is empty. Sometimes the cause is a result of worn, damaged, or misaligned components on the machine.

Whatever the cause of these events, when a new roll of film is placed on the machine, the total amount of the film applied to all the loads wrapped from that film roll can calculated and subtracted from the known number of feet of a full roll of film by the material usage tracking system. This value can represent the number of feet of stretch film not applied to the loads.

As described above, the material usage tracking system can have two sensors installed on the film delivery system to detect the presence of the film roll. A first sensor can be placed as close as possible to the film roll's core. The purpose of this sensor is to detect when the film roll has been depleted of film or the roll has been removed from the machine. If the sensor does not detect the presence of the film roll, the system will know the roll is empty or has been removed. The second sensor can be placed as close to the outer diameter of the film roll as possible. The function of this sensor can be to detect when a full roll has been placed onto the film delivery system. Placing the sensor at the outer edge of the film roll can avoid detecting a roll change if an operator removes the current roll of film and replaces the same roll back onto the machine.

If the first sensor does not detect the film roll and then while the machine is stopped, suddenly the first sensor and second sensor, both detect the presence of a film roll, then the system will know that a new, full roll of film was installed onto the machine.

I. F. Number of Pallets Wrapped Per Film Roll

The material usage tracking system can count each load that moves into the stretch wrapping machine. When a new roll is placed on the machine, this total number of loads wrapped during the previous film roll can be recorded.

In order for the material usage tracking system to provide a reliable load count, a series of events of the stretch wrapping equipment must occur before a load is counted by the system. This logical sequence is designed to prevent incorrect counts from events such as one load being wrapped several times. There are occasions when loads may be wrapped multiple times. Some of these occasions include film breaks, operators manually stopping the machine and re-wrapping the loads which can occur for a variety reasons, and maintenance personnel performing machine testing by wrapping the same load multiple times.

In order to count the load, the following events should occur. The sensor at the entrance to the stretch wrapping equipment's wrap zone should detect a load. The conveyor in the wrap area of the machine should be running in the forward direction. The sensor at the entrance to the machine's wrap zone should detect the load's presence for longer than a few seconds. This is to prevent getting false counts from someone or something flagging the sensor. The stretch wrapping equipment should be in an automatic, run mode. Only one load can be counted for each cycling of the wrap area's conveyor operation.

Base on the above criteria, an accumulative count of all the loads wrapped by the current roll of film is stored by material usage tracking system.

II. Alarm Notifications

As stated above, the material usage tracking system when employed on the different stretch wrapping equipment can eliminate and/or minimize the excessive usage of the stretch film by monitoring the use of the stretch film to alert users to problems.

For example, the material usage tracking system can provide different alarm notifications depending on the features of the system employed and the type of equipment on which it is used. The following are different alarm notifications employed by the material usage tracking system.

II. A. Excessive Number of Revolutions Applied to Load

This alarm can be generated when the machine's settings have changed in such a way that causes the machine to apply more revolutions of film per load than the benchmark setting.

Depending on the embodiment of the installed material usage tracking system, notification of personnel may vary.

In less complex embodiments of the material usage tracking system, notification of personnel of this alarm can occur by an alarm displayed on a touchscreen and possibly an indicator light located at the machine. More complex embodiments of the material usage tracking system can notify personnel of this alarm by an email to one or more people. The user can determine who receives these email alerts and how often they want to receive them.

The material usage tracking system can calculate the total feet of film applied to all the loads wrapped from the installed roll of stretch film and divides that number by the total number of loads wrapped. This value will show the average feet of film used per load. This value will be divided by the known number of feet of film used per machine revolution to determine the average number of revolutions per pallet.

Each time a load is wrapped, the number of revolutions of the wrap cycle can be compared to the benchmark number of revolutions. Whenever the machine applies more revolutions to a load than the benchmark, this event can be counted. For example, if 10 loads in a row are wrapped with a number of revolutions higher than the benchmark, the system can send an email to the customer informing them that the stretch wrapping equipment's settings have been changed. The material usage tracking system can repeat this email after every 100 loads have been wrapped in a row at the higher revolution count. These emails can continue until the user changes the stretch wrapping equipment's settings back to meet the benchmark setting for that specific load and/or piece of equipment.

II. B. Excessive Number of Film Breaks

During the benchmark testing and the installation of the material usage tracking system, a benchmark setting of a maximum allowable number of film breaks will be determined for each machine.

Depending on the features of the embodiment of the installed material usage tracking system, notification of personnel may vary. For example, in some embodiments, the material usage tracking system can notify personnel of this alarm by an alarm displayed on a touchscreen and possibly an indicator light located at the machine. In other embodiments of the material usage tracking system that employ such alarms, the system can notify personnel of this alarm by an email to one or more people. The user can determine who receives these email alerts and how often they would want to receive them.

The number of film breaks that occur on the stretch wrapping equipment can be recorded by the material usage tracking system. This number can be compared to the film break benchmark. If the number of film breaks exceeds this benchmark, an alarm can be generated.

II. C. Film Benchmarks not being Achieved

The average film weight can be compared to the benchmark film weight by the material usage tracking system. If one or two occasions of this variance occur, it does not necessarily indicate a problem. Such variances could be a result of operator interference. If several variances to the benchmark values are recorded in a row or there are consistent variances, this alarm can be generated. Depending on the features of the embodiment of the installed material usage tracking system, notification of personnel may vary. For example, in some embodiments, the material usage tracking system can notify personnel of this alarm by an alarm displayed on a touchscreen and possibly an indicator light located at the machine. In other embodiments of the material usage tracking system that employ such alarms, the system can notify personnel of this alarm by an email to one or more people. The customer would determine who receives these email alerts and how often they would want to receive them.

During the benchmark testing process, the benchmark weight of film applied to each load can be determined. The average film weight of each load can be calculated by the material usage tracking system. After each of the stretch film roll has been depleted and a new film roll is installed on the machine, the average film weight can be compared to the benchmark film weight.

III. Data Collection Analysis and Display

As described above, for more complex embodiments of the material usage tracking system, an advanced user access that uses a central database to collect and store data obtained by the sensors and controller of the system. The data can be manipulated and analyzed to provide meaningful information to monitor and optimize usage of the stretch film. Further, a user interface can be used to display and/or interact with the information. The following is a general description of a possible embodiment of the data paths and possible user interfaces that can be used as illustrated in FIGS. 8-14E.

Figure 8:
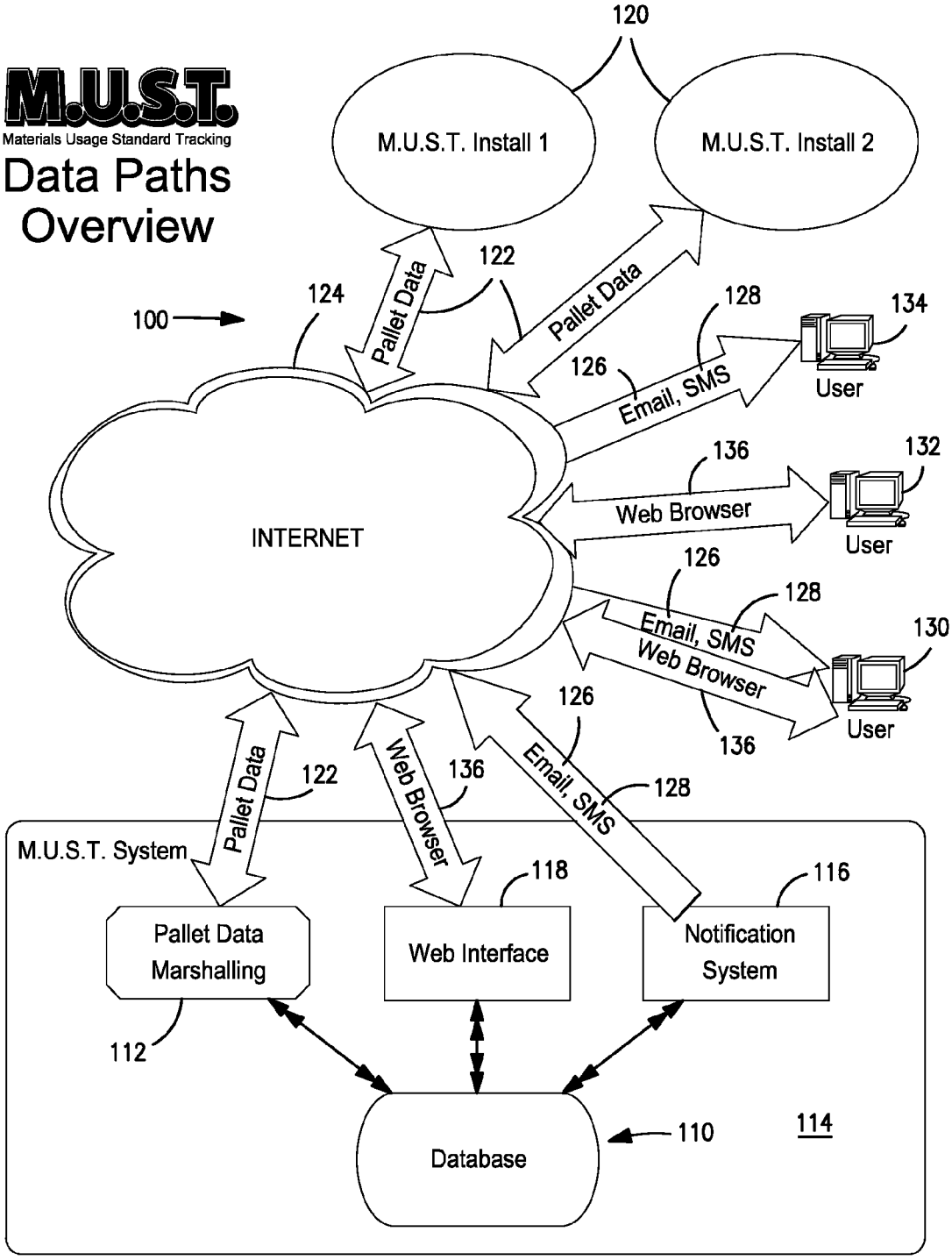
FIG. 8 illustrates a schematic representation of an embodiment of a complex material usage tracking system according to the present subject matter.

As shown in FIG. 8, the data collection and analysis component of a more complex material usage tracking system, generally designated 100, can include five primary elements that can be used with locations of multiple stretch wrapping machines and/or organizations with multiple locations 120 that include the machine level installations of the material usage tracking system 100. These elements of material usage tracking system 100 include a central database 110, a data collection element 112, a data analysis element 114, a notification element 116, and a presentation & authentication element 118.

The data, such as pallet data, 122 collected from the stretch wrapping machines at the locations 120 can be sent and/or retrieved over the internet 124. For example, a data collection element, such as a marshalling program, 112 can be used to retrieve such data 122. Data Marshalling is the process by which information about each pallet is added to or updated in the database. Pallet data 122 should be unique to be used in accurate production reporting. When new pallet data 122 is detected by the marshalling software 112, the marshalling software 112 checks the database for matching information and updates the existing information if it already exists. In the much more common case, pallet data 122 is inserted into the central database 110.

Alert conditions can be set for the notification element 116 depending on the data 122 received and stored in the central database 110. The notification element 116 performs periodic inspection of the pallet data 122. Alert conditions are based on stretch film packaging analysis customized to the load types being monitored on a given packaging line performed by the analysis element 114. Package lines status is updated based upon those analyses. If a notification is to be sent, an e-mail 126 or SMS 128 can be used to send notification information when alarm conditions occur to users 130, 134. Period pre-calculation of relevant information allows the material usage tracking system to generate graph and report information more rapidly than otherwise.

To access the graphs and report information, the presentation and authentication element, such as web interface, 118 can be provided. Each user 130, 132, 134 can access certain of such graphs and report information as need or allow through a web browser 136 as will be explained in more detail below. The web interface 118 provides a convenient structure for accessing the status of a packaging line or viewing reports or graphs of data for a line. The web interface 118 is hierarchical in structure requiring logical traversal of one layer to reach another.

The different elements are described in more detail below.

III.A. Database

The data collection and analysis component can rely on tight integration with a database. The database can hold configuration details specific to the implementation of the material usage tracking system on individual packaging lines. For example, the circumference of the pre-stretch roller referenced to the number of pulses for each line can be stored in this database as are the details of the film being used. The target benchmarks for various pallet configurations can be stored in the database. Other details like identification strings, time domain specific information and the collected data can also be stored in the database. The specific database is not critical as the underlying database is abstracted into a database class by the software allowing the specific embodiment of the material usage tracking system to be used at different locations on different operating systems and seamless upgrades to the server hardware if increased performance becomes necessary. The design of the material usage tracking system does not specify a particular database platform to allow replacement of the underlying database if it becomes a security risk or performance block.

As an example of a structure of a database, Tables 1, 2, and 3 shown possible database table definitions that could be used and the columns used within the database. In Table 1, the table for stretch film usage can include table columns such as a unique row identifier, a timestamp column to record the time of the pallet wrapping event, and a location column to identify the organization and location from which the information was collected. The film usage table can also include a machine ID column to identify the specific piece of stretch wrapping equipment at the specific location, a wrap pattern ID column to identify the optional wrapper pattern that can be used between various benchmark film usage values, and a feet to film column to record the feet of film used to wrap a given pallet.

TABLE 1

Table Columns for Stretch Film Usage Table

| | | |
|---|---|---|
| 1. | id | records the time of the pallet wrapping event |
| 2. | timestamp | identifies the organization and location |
| 3. | location | identifies the specific wrapper at the location |
| 4. | machine_id | identifies the specific wrapper at the location |
| 5. | wrap_pattern_id | identifies the optional wrapper pattern that can be used to differentiate between various benchmark film usage values. |
| 6. | feet_of_film | records the feet of film wrapping a given pallet |

In Table 2, the table for roll changes can include table columns such as a unique row identifier, a timestamp column to record the time of the pallet wrapping event, and a location column to identify the organization and location from which the information was collected. The roll change table can also include a machine ID column to identify the specific piece of stretch wrapping equipment at the specific location and a total feet column to record the feet of film remaining on a roll at change. The roll change table can also include a total breaks column to record the total number of film breaks recorded on a roll and a break (1) through breaks (n) column to record the number of breaks at each phase of wrap, where (n) equals the number of phases of the wrap.

TABLE 2

Table Columns for Roll Changes Table

| | | |
|---|---|---|
| 1. | id | records the time of the pallet wrapping event |
| 2. | timestamp | identifies the organization and location |
| 3. | location | identifies the specific wrapper at the location |
| 4. | machine_id | identifies the specific wrapper at the location |
| 5. | total_feet | number of feet remaining on roll at change |
| 6. | total_breaks | total number of film breaks recorded |
| 7. | breaks_1 through breaks_n | number of breaks at each phase of wrap |

In Table 3, the table for combined data can include table columns such as a unique row identifier, a timestamp column to record the time of the pallet wrapping event, and a machine ID column to identify the specific piece of stretch wrapping equipment at the specific organization, location and machine. The combined data table can also include a feet per pallet column to record the feet of film used to wrap a pallet/product, a revolutions column to record the number of revolutions of the pallet/product, and a pallet count column to record the total number of pallets wrapped with a roll of film. Additionally, the combined data table can include a total feet column to record the total number of feet of film removed from a specific roll and an average feet column to record the cumulative average feet of film per pallet on a specific roll. Further, the combined data table can include a breaks column to record the cumulative film breaks recorded on a specific roll and a break (1) through breaks (n) column to record the cumulative number of film breaks per location on a specific roll.

TABLE 3

Table Columns for Combined Data Table

| | | |
|---|---|---|
| 1. | id | records the time of the pallet wrapping event |
| 2. | timestamp | identifies the organization and location |
| 3. | machine_id | identifies the specific wrapper at the location |
| 4. | feet_per_pallet | feet of film used to wrap pallet |
| 5. | revolutions | number of revolutions on this pallet |
| 6. | pallet_count | total pallets wrapped with this roll of film |
| 7. | total_feet | total feet removed from a roll |
| 8. | average_feet | cumulative average feet per pallet on a roll |
| 9. | breaks | cumulative film breaks on a roll |
| 10. | breaks_1 through breaks_(n) | cumulative number of film breaks per location on a Roll |

III.B. Data Collection Element

The data collection element can be different software that operates in different ways. For example, the data collection element can manage the communication from a data logger and store the information in the database element for use by the analysis and presentation elements. Alternatively, the data collection element can be data marshalling software that periodically queries to determine if new data has been has been collected at a specific machine at a specific location. Data Marshalling is the process by which information about each pallet is added to or updated in the database. Pallet data should be unique to be used in accurate production reporting. When new pallet data is detected by the marshalling software, the marshalling software checks the database for matching information and updates the existing information if it already exists.

In the much more common case, pallet data is inserted into the database. This element also performs categorization and analysis on the data as its being collected. This is accomplished by storing the requisite values in the database element for use by the data collection element as it categorizes.

Categorization is used in this context to refer to the process of further classifying the raw data based on specific details about the line. For example, a packaging line that is processing pallets of "fridge packs" of canned soda drinks will require a different amount of stretch film to secure than a similar line processing a more uneven load configuration. After categorization, the data is stored by the data collection element in the database element described above.

III.C. Analysis and Notification Elements

Data collection can be performed on data as it is transmitted to the system. Analysis can be performed by the analysis element at certain regular intervals to minimize processing load on the server and to manage the data in a more useful way. The analysis element can be a computer program that accesses the data in the central database to create information useful for the end user. For example, the useful information can be the information recorded that is discussed above, related graphs, reports and trend data. The analysis element can provide many details about each packaging line at a specific location. The analysis element can provide the details such as the last measurement of film used per pallet which is the fundamental data collected by the system. The analysis element can also provide details such as the weighted moving average film used per pallet which can be generated whenever a graph or table of this value needs to be created. The analysis element can also provide information on the trend for amount film used per pallet which can be calculated using a standard slope trend calculation.

The analysis element can provide details such as the last pallets wrapped per film roll, which is a simple addition of the pallets wrapped between recorded roll changes. The analysis element can provide the details on the weighted moving average pallets wrapped per film roll and the pallets wrapped per film roll trend, which can be also be calculated using a standard slope trend calculation.

The analysis element can also provide details such as the current rate of average film roll use per day, month, and/or year. Additionally, the analysis element can provide details such as anomalous events requiring notification or investigation which can require complex multivariable analysis algorithms dependent on the events in question which will be different for each implementation. The analysis element can also provide details such as the identifiable periods of non-standard operation using specific standards and allowable variance (stored in Database) for comparison. Further, the analysis element can provide details such as the reduction in film usage from pre-audit levels and extrapolated savings based on audit values (stored in Database) for comparison. The analysis element can also provide details such as the last revolutions per pallet and the weighted moving average revolutions per pallet. Further, the analysis element can also provide details such as the film breaks by break location which can be collected parallel to the film and revolutions per pallet.

This analysis information can drive the notification element which can be categorized as a sub-element of the analysis element. Notification is configured to send notification to key personnel if there is an anomalous event, such as repetitious film breaks, a packaging line being down, or a change in the amount of film being applied to each pallet. Notification can be by way of email, cell phone text message, or pager.

The Presentation & Authentication Layer is discussed separately in the next section.

III.D. Presentation and Authentication Element

Different aspects of the data can be important to different users of the material usage tracking system. Designing the multiple presentations needed for the data is more easily accomplished with the use of user roles. User roles organize the needs of a system user based on how the user will want to view the data. Different user roles create access to certain data that is important to a certain class of user within a company. Each company can customize what data and analysis is supplied to a specific group. For example, the Vice-president of Purchasing is probably more concerned with how much stretch film is being saved after implementation of the material usage tracking system. In contrast, a Production Manager will probably be more concerned with monitoring faults and down time.

III.D.1. Examples of User Roles

The following user roles are examples that can be defined for the presentation requirement analysis:

a. Production Executive—

This user role can be for an executive in charge of all production at multiple facilities.

b. Purchasing Executive—

This user role can be for an executive in charge of all purchasing at multiple facilities.

c. Production Manager—

This user role can be for the manager of production at one facility or a General Manager role.

d. Purchasing Manager—

This user role can be for the manager of purchasing at one facility.

e. Maintenance Manager—

This user role can be for the manager of maintenance at one facility.

f. Production Supervisor—

This user role can be for the supervisor of one shift of production.

g. Maintenance Supervisor—

This user role can be for the supervisor of one maintenance shift.

As stated above, different user roles can have access to different information and such information can be defined by the user. The information and analysis provided to the different user roles can include graphs. Based on the data collected and stored in the database, a plethora of different graphs to communicate the information can be provided. For example, here are descriptions of the various graphs that can be displayed:

III.D.2. Examples of Single Plot Graphs a. Film/Pallet—

This graph can plot the amount of film used for each pallet along the y-axis against time on the x-axis. The film can be measured in ounces or grams. A smoothing algorithm can also be applied to the data.

b. Pallets/Roll—

This graph can plot the number of pallets wrapped by each successive roll on the y-axis against a roll change time on the x-axis. A smoothing algorithm may also be applied to the data.

c. Pallets/Time Period—

This graph can plot the number of pallets wrapped on the y-axis against a specified time interval such as hour, shift, day, week or month.

d. Rolls/Time Period—

This graph can plot the number of rolls used on the y-axis against a specified time interval such as hour, shift, day, week or month.

Different options can be provided to further enhance the graphs provide. For example, a shift shading feature can show shifts as different colors on the background of the graph for reference and an anomaly marker feature can add a vertical marker along the time axis to indicate anomalous occurrences.

III.D.3. Examples of Dual Plot Graphs a. Film/Pallet with Pallets/Roll—

This dual graph can include a single plot graph of the film pallet graph described above with an additional overlay line of Pallets/Roll using secondary y-axis.

b. Film/Pallet with Pallets/Roll [Alternative Implementation]—

This dual graph can include a single plot graph of the film pallet graph described above with an additional bar graph of Pallets/Roll using secondary y-axis. This style of graph commonly is seen in the financial industry where stock price is plotted with volume.

III.D.4. Modular Design

The design of the Presentation & Authentication Element can feature interfaces customized to the login used. The customization can include using the same company logo for all logins belonging to an organization for example. Different users will prefer different display configurations, so this element is designed to support modular inclusion and exclusion of interface elements.

III.D.5. Overview of Presentation Layers

Figure 9:
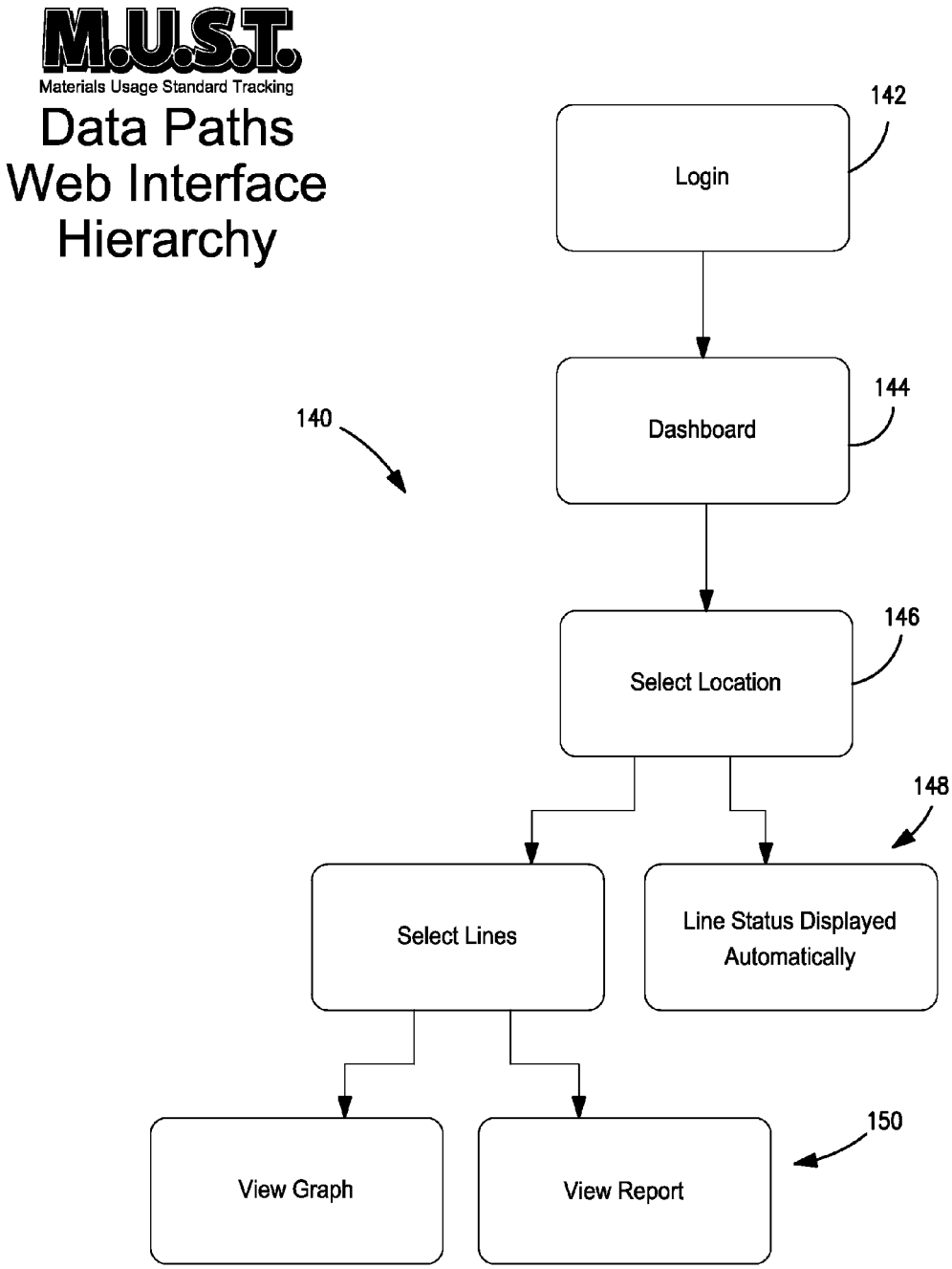
FIG. 9 illustrates a schematic representation of an embodiment of a web interface hierarchy for a material usage tracking system according to the present subject matter.

In providing a web user interface to the user as shown in FIG. 9, a hierarchical web interface 140 can be provided. The first layer can be the authentication layer 142 that provides access to the other layers of the web interface 140. Once logged in, a second layer in the form of an organization overview layer 144 can be accessed. The organization overview layer 144 can provide organizational and location status overview. A deeper layer of information can be accessed through the location overview layer 146 that provides a location status overview as well as specific line status updates regarding the usage of the stretch film. If more information is desired, then the line detail layer 148 can be accessed with properly approved. The layer detail layer 148 can provide aggregate and individual line status information. The most detailed information can be found in the report layer 150. The report layer 150 can provide detailed reports and graphs on stretch film usage. Examples of five (5) separate presentation layers are provided in more detail below.

a. Authentication

At the authentication layer as shown in FIG. 10, a login [for example an email address] and password can be required for access to the other presentation layers. The Authentication process uniquely identifies the user [or at least the user role for that user] logging in which allows the material usage tracking system to filter the data, graphs and reports that are available. For example, the production manager of one location might not have the authority to view the data from another location in the same organization whereas the vice-president of manufacturing of the organization may have full access to all aspects of the system for their organization.

b. Organization Overview

Figure 11A:
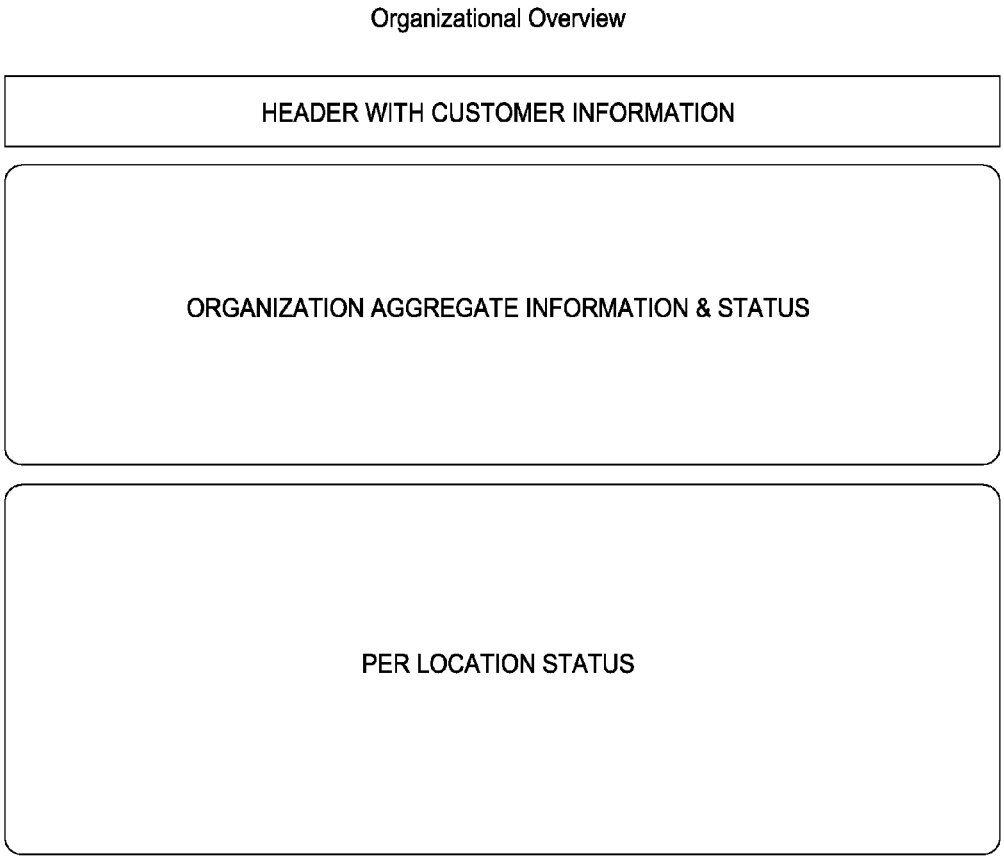
Figure 11C:
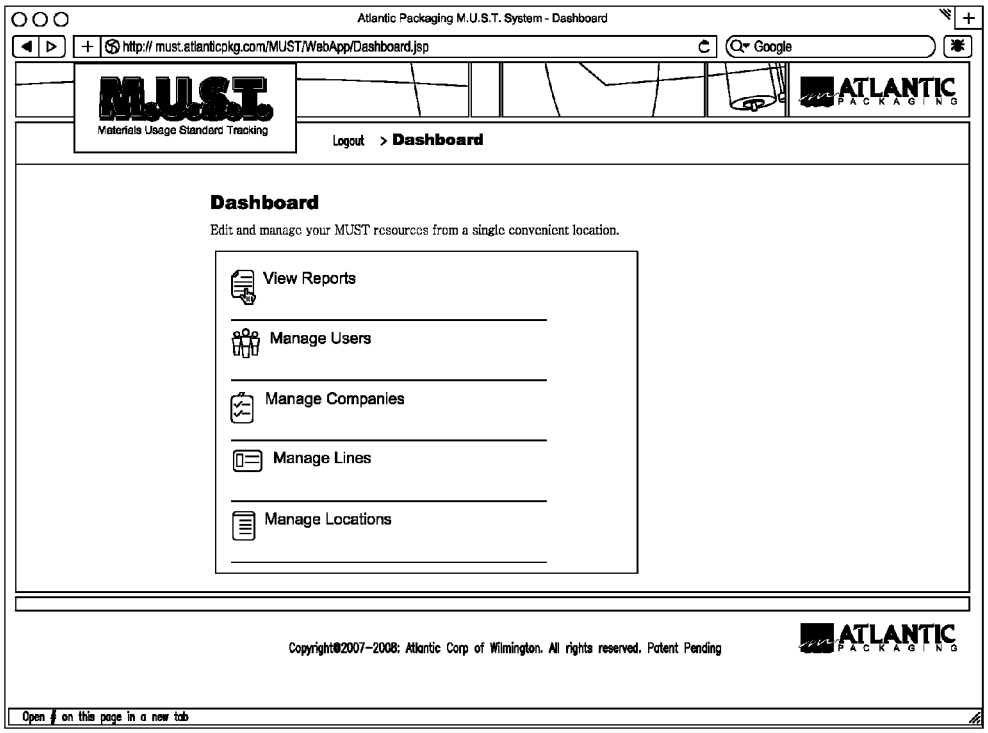

The organization overview layer shows an organizational "snapshot" consisting of a simple status listing for each location and aggregate values for monthly pallets, film usage and savings over the audited values. Examples of webpage layouts and possible information regarding stretch film usage at the organizational level are illustrated in FIGS. 11A, 11B, and 11C. Investigating the data further in a specific location takes the user to the location overview layer.

c. Location Overview

Figure 12A:
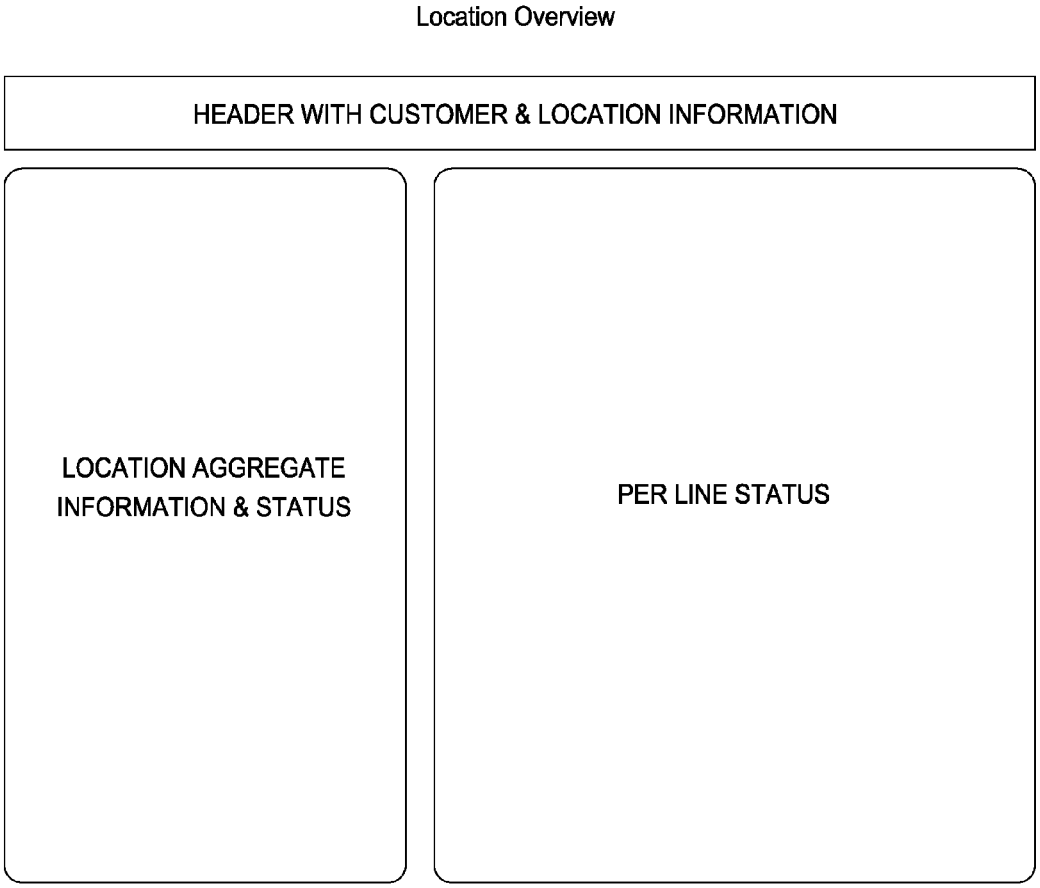
Figure 12C:
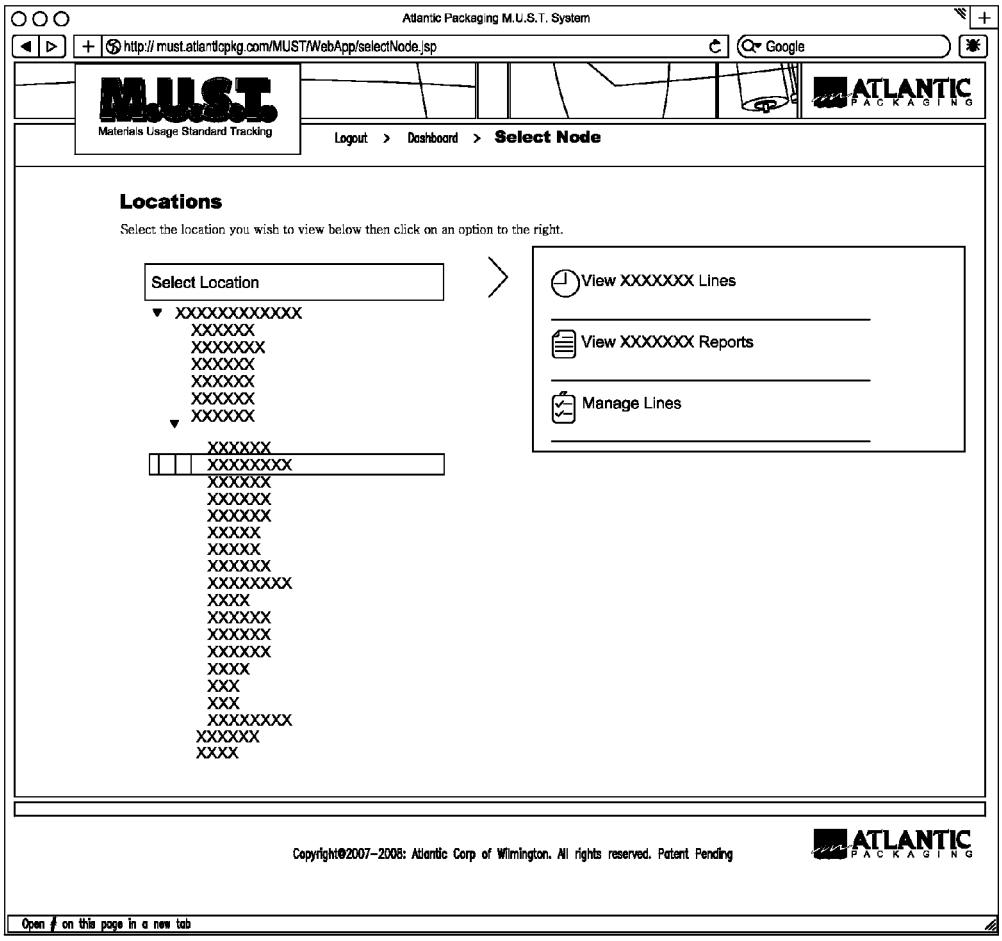

The location overview layer shows a location "snapshot" consisting of a simple status listing for each packaging line, aggregate values for monthly pallets, film usage and savings over the audited values. Examples of webpage layouts and possible information regarding stretch film usage at the location level are illustrated in FIGS. 12A, 12B, and 12C. Investigating the data further in a specific line takes the user to line detail layer for that line.

d. Line Detail

Figure 13A:
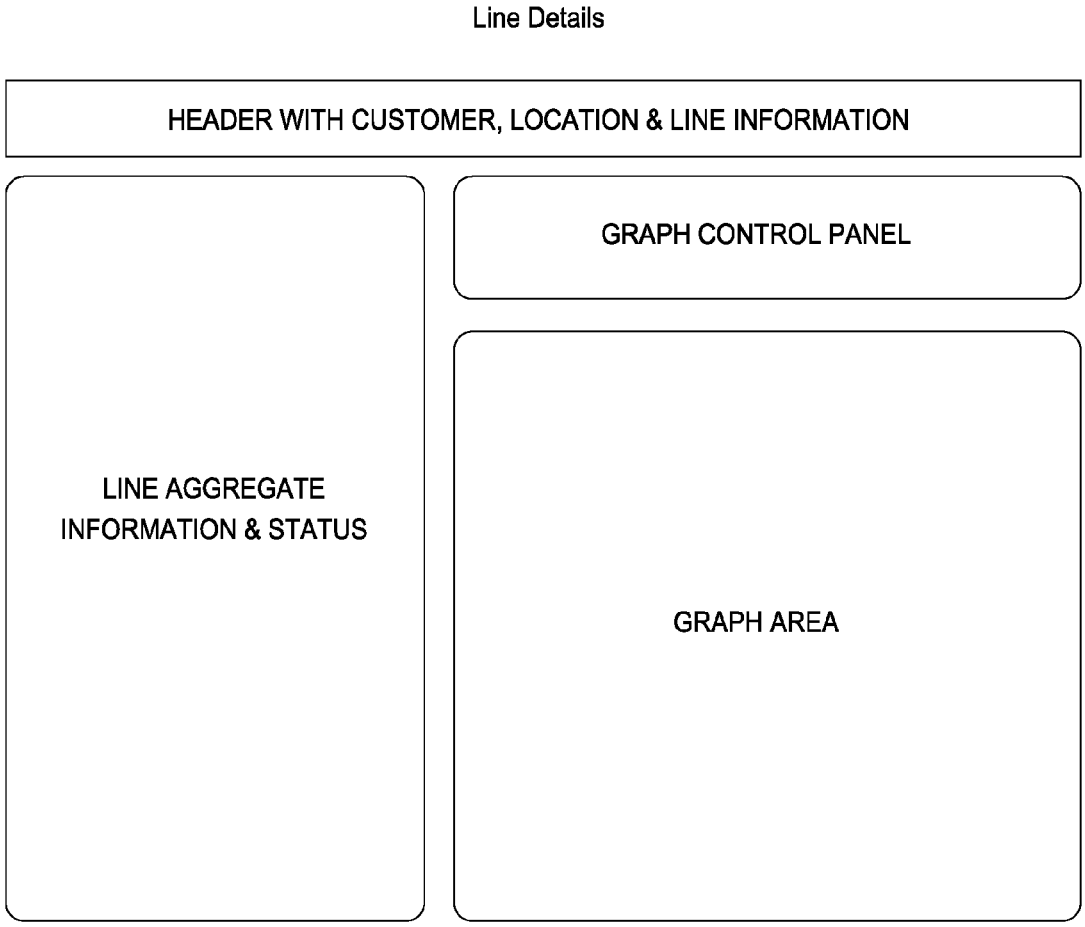
Figure 14A:
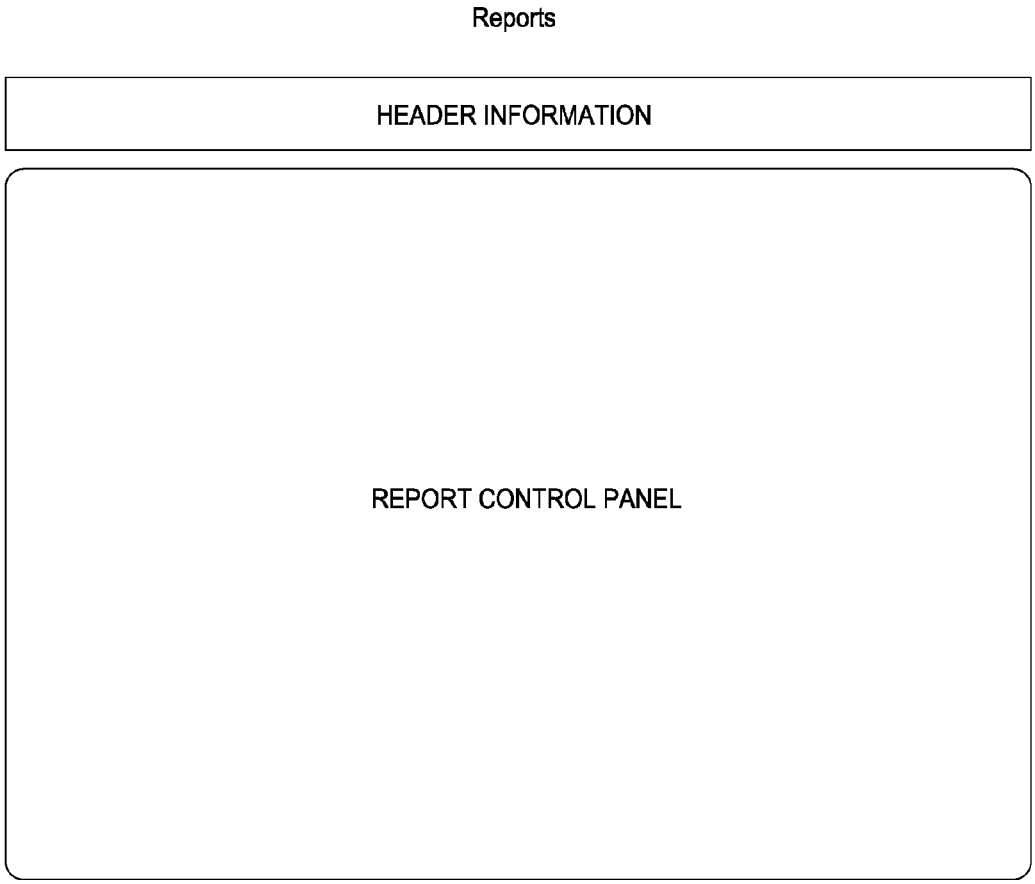
Figure 14C:
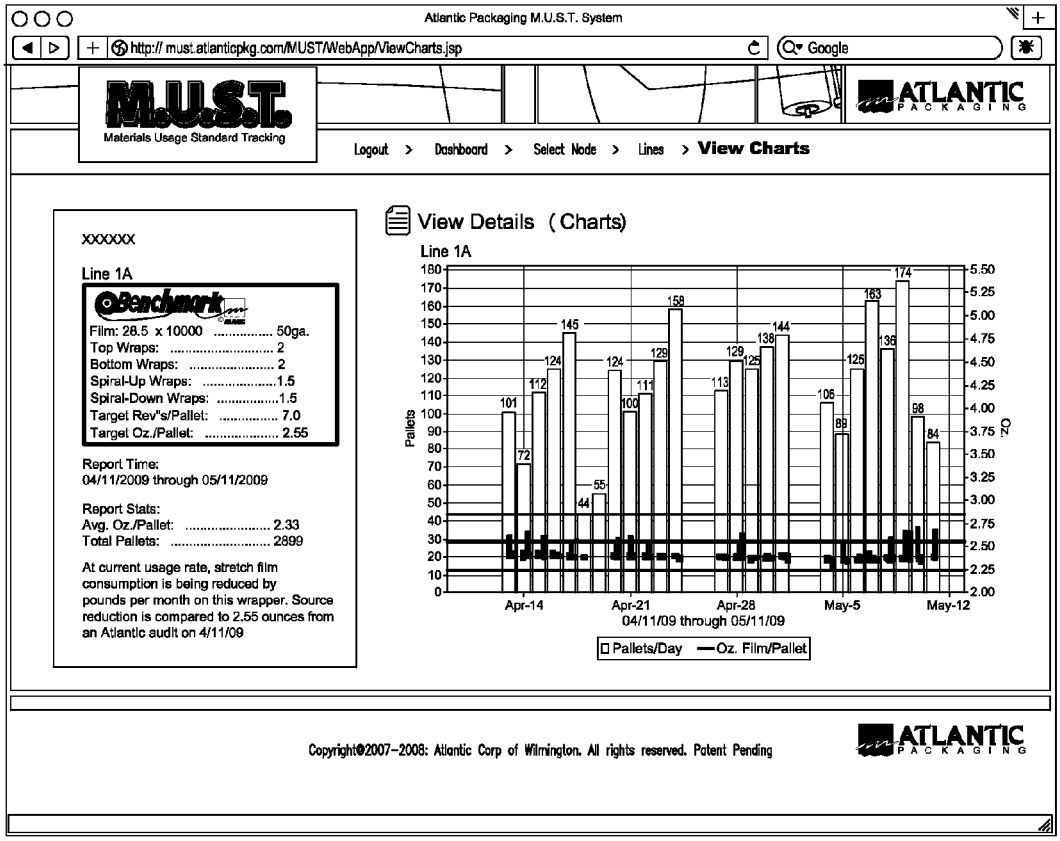

The line detail layer shows detailed status and aggregate information about the particular line and optional graphs. Examples of webpage layouts and possible information regarding stretch film usage at the specific lines are illustrated in FIGS. 13A, 13B, and 13C.

e. Reports

The reports layer provides an interface for the user to pick selected reports to be generated. Available reports are dependent on the user's authentication. Examples of webpage layouts and possible information regarding stretch film usage available in the reports and graphs are illustrated in FIGS. 14A, 14B, 14C, 14D and 13E.

Through the use of material usage tracking systems described above, different organizations as a user of the respective system can obtain and utilize as much information as they need to monitor and optimize the organization's use of stretch film in wrapping their products or pallets for shipping. Embodiments of the present disclosure shown in the drawings and described above are exemplary of numerous embodiments that can be made within the scope of the appending claims. It is contemplated that the configurations of the material usage tracking systems can comprise numerous configurations other than those specifically disclosed. The scope of a patent issuing from this disclosure will be defined by these appending claims.

What is claimed is:

1. A material usage tracking system for monitoring and optimizing usage of stretch film on a stretch wrapping machine used to wrap products or pallets of products, the system comprising:

a rotary encoder collar configured to be securable to a pre-stretch roller of a stretch wrapping machine;

a proximity sensor configured for placement proximate to the rotary encoder collar, upon installation, the proximity sensor configured to measure the revolutions of the pre-stretch roller based on the rotation of the rotary encoder collar when the stretch wrapping machine is wrapping a product or pallet;

a controller in communication with the proximity sensor, the controller configured to convert the revolutions of the pre-stretch roller into a measurement of the amount of stretch film pulled off a stretch film roll in the stretch wrapping machine based on data received from the proximity sensor; and wherein the measurement of the amount of stretch film pulled off a stretch film roll is compared to a benchmark value for an amount of stretch film that is expected to be used for the type of product or pallet being wrapped.

2. The system according to claim 1, wherein the rotary encoder collar comprises a plurality of inserts evenly distributed around the circumference of the rotary encoder collar.

3. The system according to claim 2, wherein the proximity sensor measures the revolutions of the pre-stretch roller based on the detection of the plurality of inserts.

4. The system according to claim 1, wherein the controller is further configured to provide an alarm notification upon determination that the amount of stretch film is not about equal to the benchmark value.

5. The system according to claim 1, wherein the controller comprises a programmable logic controller.

6. The system according to claim 1, wherein the controller is configured to be in communication with the stretch wrapping machine to collect data therefrom.

7. The system according to claim 6, wherein the controller is configured to detect the number of revolutions of at least one of a turntable or a rotatable arm of the stretch wrapping machine to wrap the product or pallet.

8. The system according to claim 6, wherein the controller is configured to detect when a top of the product or pallet is having top wraps applied thereto.

9. The system according to claim 8, wherein the controller is configured to detect the number of revolutions of at least one of a turntable or a rotatable arm of the stretch wrapping machine to wrap a top of the product or pallet.

10. The system according to claim 6, wherein the controller is configured to detect when a bottom of the product or pallet is having bottom wraps applied thereto.

11. The system according to claim 10, wherein the controller is configured to detect the number of revolutions of at least one of a turntable or a rotatable arm of the stretch wrapping machine to wrap a bottom of the product or pallet.

12. The system according to claim 6, wherein the controller is configured to detect when the stretch wrapping machine completes a wrap cycle.

13. The system according to claim 6, wherein the controller is configured to count the number of products or pallets wrapped per stretching wrapping machine.

14. The system according to claim 6, wherein the controller is configured to detect a wrap pattern when multiple wrap patterns are applied by the stretch wrapping machine.

15. The system according to claim 1, further comprising a first film detection sensor configured to be positioned proximal to a roll center of a diameter of a roll of stretch film when placed in the stretch wrapping machine and second film detection sensor configured to be positioned proximal to an outer diameter of a roll center of a full roll of stretch film when placed in the stretch wrapping machine.

16. The system according to claim 15, wherein the controller is configured to detect when a roll is changed.

17. The system according to claim 15, wherein the controller is configured to count the number of products or pallets wrapped per roll of stretch film.

18. The system according to claim 1, further comprising a central database in communication with the controller, the central database collecting and storing data from the controller.

19. The system according to claim 18, further comprising a data collection element in communication with the central database and the controller to retrieve data from the controller and store it in the central database.

20. The system according to claim 18, wherein the data stored on the central database is analyzed to provide information to monitor and optimize the stretch wrapping machine.

21. The system according to claim 20, wherein the information provided is a last measurement of film used per pallet.

22. The system according to claim 20, wherein the information provided is a weighted moving average film used per pallet.

23. The system according to claim 20, wherein the information provided is a trend for amount film used per pallet.

24. The system according to claim 20, wherein the information provided is a weighted moving average pallets wrapped per film roll.

25. The system according to claim 20, wherein the information provided is an average film roll use per day, month, and/or year.

26. The system according to claim 20, wherein the information provided is anomalous events requiring notification or investigation.

27. The system according to claim 20, wherein the information provided is provided in the form of one or more graphs.

28. The system according to claim 27, wherein the one or more graphs are at least one of single plot graphs or dual plot graphs.

29. The system according to claim 20, further comprising a user interface to access the information, the user interface comprising one or more presentation layers.

30. The system according to claim 29, wherein the one or more presentation layers comprises an authentication layer.

31. The system according to claim 29, wherein the one or more presentation layers comprises an organization overview layer.

32. The system according to claim 29, wherein the one or more presentation layers comprises a location overview layer.

33. The system according to claim 29, wherein the one or more presentation layers comprises a line detail layer.

34. The system according to claim 29, wherein the one or more presentation layers comprises a reports layer.

35. The system according to claim 18, wherein an analysis element can access the data in the central database to create information useful for the end user.

36. The system according to claim 35, wherein the analysis element is configured to access the benchmark value for an amount of stretch film that is expected to be used for the type of product or pallet being wrapped and configured to compare the measurement of the amount of stretch film pulled off the stretch film roll to the benchmark value.

37. The system according to claim 1, wherein the controller is configured to access the benchmark value for an amount of stretch film that is expected to be used for the type of product or pallet being wrapped and configured to compare the measurement of the amount of stretch film pulled off the stretch film roll to the benchmark value.

38. A material usage tracking system for monitoring and optimizing usage of stretch film on multiple stretch wrapping machines used to wrap products or pallets of products, the system comprising:

a plurality of rotary encoder collars, each rotary encoder collar configured to be securable to a pre-stretch roller of a respective stretch wrapping machine;

a plurality of proximity sensors, each proximity sensor configured for placement proximate to a respective rotary encoder collar, upon installation, each proximity sensor configured to measure the revolutions of the pre-stretch roller of the respective wrapping machine based on the rotation of the rotary encoder collar when the respective stretch wrapping machine is wrapping a product or pallet;

a plurality of controllers, each controller in communication with a respective proximity sensor, the controller configured to convert the revolutions of the corresponding pre-stretch roller into a measurement of the amount of stretch film pulled off a stretch film roll in the respective stretch wrapping machine based on data received from the proximity sensor; and a central database in communication with each of the plurality of controllers, the central database collecting and storing data from each controller, the data stored on the central database is analyzed to provide information to monitor and optimize the stretch wrapping machine.

39. The system according to claim 38, wherein each rotary encoder collar comprises a plurality of inserts evenly distributed around the circumference of the rotary encoder collar.

40. The system according to claim 39, wherein each proximity sensor measures the revolutions of the pre-stretch roller based on the detection of the plurality of inserts.

41. The system according to claim 38, wherein each controller is further configured to provide an alarm notification upon determination that the amount of stretch film is not about equal to a benchmark value.

42. The system according to claim 41, wherein the alarm notification comprises an e-mail sent to a user.

43. The system according to claim 41, wherein the alarm notification comprises an alarm light that flashes.

44. The system according to claim 38, wherein each controller is configured to be in communication with the corresponding stretch wrapping machine to collect data therefrom.

45. The system according to claim 44, wherein each controller is configured to detect the number of revolutions of at least one of a turntable or a rotatable arm of the corresponding stretch wrapping machine to wrap the product or pallet.

46. The system according to claim 44, wherein each controller is configured to detect when a top of the product or pallet is having top wraps applied thereto.

47. The system according to claim 46, wherein each controller is configured to detect the number of revolutions of at least one of a turntable or a rotatable arm of the corresponding stretch wrapping machine to wrap a top of the product or pallet.

48. The system according to claim 44, wherein each controller is configured to detect when a bottom of the product or pallet is having bottom wraps applied thereto.

49. The system according to claim 48, wherein each controller is configured to detect the number of revolutions of at least one of a turntable or a rotatable arm of the corresponding stretch wrapping machine to wrap a bottom of the product or pallet.

50. The system according to claim 44, wherein each controller is configured to detect when the corresponding stretch wrapping machine completes a wrap cycle.

51. The system according to claim 44, wherein each controller is configured to count the number of products or pallets wrapped per stretching wrapping machine.

52. The system according to claim 44, wherein each controller is configured to detect a wrap pattern when multiple wrap patterns are applied by the stretch wrapping machine.

53. The system according to claim 38, further comprising, for each stretch wrapping machine, a first film detection sensor configured to be positioned proximal to a roll center of a diameter of a roll of stretch film when placed in the stretch wrapping machine and second film detection sensor configured to be positioned proximal to an outer diameter of a roll center of a full roll of stretch film when placed in the stretch wrapping machine.

54. The system according to claim 53, wherein each controller is configured to detect when a roll is changed.

55. The system according to claim 53, wherein each controller is configured to count the number of products or pallets wrapped per roll of stretch film.

56. The system according to claim 38, further comprising a data collection element in communication with the central database and the controller to retrieve data from the controller and store it in the central database.

57. The system according to claim 56, wherein the data stored on the central database is analyzed to provide information to monitor and optimize the stretch wrapping machine.

58. The system according to claim 57, wherein the information provided is a last measurement of film used per pallet.

59. The system according to claim 57, wherein the information provided is a weighted moving average film used per pallet.

60. The system according to claim 57, wherein the information provided is a trend for amount film used per pallet.

61. The system according to claim 57, wherein the information provided is a weighted moving average pallets wrapped per film roll.

62. The system according to claim 57, wherein the information provided is an average film roll use per day, month, and/or year.

63. The system according to claim 57, wherein the information provided is anomalous events requiring notification or investigation.

64. The system according to claim 57, wherein the information provided is provided in the form of one or more graphs.

65. The system according to claim 64, wherein the one or more graphs are at least one of single plot graphs or dual plot graphs.

66. The system according to claim 57, further comprising a user interface to access the information, the user interface comprising one or more presentation layers.

67. The system according to claim 66, wherein the one or more presentation layers comprises an authentication layer.

68. The system according to claim 66, wherein the one or more presentation layers comprises an organization overview layer.

69. The system according to claim 66, wherein the one or more presentation layers comprises an location overview layer.

70. The system according to claim 66, wherein the one or more presentation layers comprises a line detail layer.

71. The system according to claim 66, wherein the one or more presentation layers comprises a reports layer.

72. The system according to claim 38, wherein an analysis element can access the data in the central database to create information useful for the end user.

73. The system according to claim 72, wherein the analysis element is configured to access a benchmark value for an amount of stretch film that is expected to be used for the type of product or pallet being wrapped and configured to compare the measurement of the amount of stretch film pulled off the stretch film roll to the benchmark value.

* * * * *